US005532798A

United States Patent [19]

Nakagami et al.

[11] Patent Number: 5,532,798

[45] Date of Patent: Jul. 2, 1996

[54] CHARGING DEVICE HAVING A PLATE ELECTRODE AND A CLEANING DEVICE FOR CLEANING EDGES OF THE PLATE ELECTRODE

[75] Inventors: Yasuhiro Nakagami; Kouji Matsushita; Noboru Yonekawa, all of Toyokawa; Noboru Ito, Kawanishi; Yoshihiro Shojo; Katsuhiko Takeda, both of Itami, all of Japan

[73] Assignee: Minolta Camera Kabushiki Kaisha, Osaka, Japan

[21] Appl. No.: 247,862

[22] Filed: May 23, 1994

[30] Foreign Application Priority Data

| | | | |
|---|---|---|---|
| May 26, 1993 | [JP] | Japan | 5-124352 |
| Jun. 22, 1993 | [JP] | Japan | 5-174987 |
| May 16, 1994 | [JP] | Japan | 6-101241 |

[51] Int. Cl.[6] ..... G03G 15/02

[52] U.S. Cl. ..... 355/221; 355/215; 355/219

[58] Field of Search ..... 355/215, 219, 355/221, 224, 261, 264, 298; 361/225; 250/324, 325, 326

[56] References Cited

U.S. PATENT DOCUMENTS

| | | | |
|---|---|---|---|
| 3,978,379 | 8/1976 | DelVecchio | 355/221 X |
| 4,566,777 | 1/1986 | Honda et al. | 355/219 X |
| 4,885,466 | 12/1989 | Koichi et al. | 355/215 X |
| 4,956,671 | 9/1990 | Otsuka | 355/215 |
| 5,012,093 | 4/1991 | Shimizu | 250/324 |

FOREIGN PATENT DOCUMENTS

| | | | |
|---|---|---|---|
| 59-111656 | 6/1984 | Japan | 355/221 |
| 1-107282 | 4/1989 | Japan | 355/221 |
| 1-312563 | 12/1989 | Japan . | |
| 2-75658 | 6/1990 | Japan . | |
| 4-181273 | 6/1992 | Japan | 355/219 |

*Primary Examiner*—Sandra L. Brase
*Attorney, Agent, or Firm*—Willian Brinks Hofer Gilson & Lione

[57] ABSTRACT

A charging device with a plate-like electrode having a plurality of protrusions, the charging device having a cleaning device including cleaning members which are positioned bilaterally to the electrode and grip the electrode therebetween to clean. The cleaning device cleans the electrode while the cleaning members slide on a guide formed along the electrode, or the cleaning device cleans the electrode by griping the electrode by the cleaning members which are positioned along the electrode.

19 Claims, 24 Drawing Sheets

85
85a
86
2
2a
81a
81b

CHARGING DEVICE HAVING A PLATE ELECTRODE AND A CLEANING DEVICE FOR CLEANING EDGES OF THE PLATE ELECTRODE

BACKGROUND OF THE INVENTION

1. Field of the Invention

The present invention relates to cleaning a plate-like electrode having serrated edges (hereinafter referred to as "plate electrode") for use in a charging device for image forming apparatus such as copiers, printers and the like.

2. Description of the Related Art

In conventional image forming apparatus such as copiers, printers and the like, charging devices are used to charge an image-carrying member, transfer a toner image from said image-carrying member onto a transfer sheet, and separate said transfer sheet from said image-carrying member. A linear type electrode comprising a wire of about 50 μm to accomplish discharge is typically used as the aforesaid charging device.

Charging devices of the aforesaid type, however, are disadvantageous inasmuch as the extremely fine wire used as the aforesaid linear electrode is readily broken, thereby making it very difficult to assemble the charging device.

When a charging device using the aforesaid linear electrode emits a discharge to an image-carrying member, said discharge rises 360° around the wire used as the electrode, such that the majority of the discharge current does not flow to the image-carrying member side, but flows to a stabilizer or the like provided around the periphery of said wire. Furthermore, the percentage of the discharge current that flows to the image-carrying member is small, making it necessary to supply a large current to achieve adequate discharge relative to the image-carrying member, thus a high voltage current is applied to said wire.

However, it is extremely dangerous to handle said wire when a high voltage is applied to the wire as previously described. Furthermore, a large amount of ozone is generated by the aforesaid discharge, such that the ozone thus generated causes deterioration of the cleaning blade and image-carrying member and the like, as well as adversely affecting the environment.

The use of plate electrodes as corona charging devices that generate small amounts of ozone is well known. A plate electrode is disclosed in Japanese Laid-Open Patent Application No. Hei 1-312563, wherein said electrode is provided with a plate projection. When using a plate electrode, only ¼ the amount of ozone is generated compared with the amount of ozone generated when using a corona wire under identical output. When a plate electrode is used, the discharge current may be reduced because a large current flow to the stabilizer is not necessary to stabilize the discharge. Thus, if the discharge current is reduced, the amount of ozone generated can also be reduced.

In corona charging devices using a plate electrode, silicon (Si) adheres to and grows radially on the exterior periphery of the plate electrode due to repeated discharges, and said silicon growth causes irregular discharges. Over time, toner and paper debris adhere to the plate electrode and cause irregular discharges. When a corona charging device which is in a state of generating irregular discharges is used for discharge, while streaks are produced in the formed image, and produce locally inadequate transfer when used to effect transfers.

Silicon that adheres to the plate electrode can be removed by light rubbing, and if removed, discharge is stabilized. Cleaning devices for removing silicon and the like adhering to a plate electrode are well known, such as that disclosed in Japanese Laid-Open Utility Model Application No. Hei 2-75658. This cleaning device rotates while pressing a roller-shaped sponge member against plate electrode from the direction of discharge. The plate electrode is embedded in the aforesaid sponge member via the pressure applied by said sponge member, such that the silicon adhered to the lateral surfaces of the plate electrode is removed therefrom.

In the cleaning device disclosed in the previously mentioned Japanese Laid-Open Utility Model Application No. Hei 2-75658, the tip of the plate electrode become caught in the fine holes in the surface of the sponge member so as to damage said sponge member, and the sponge fragments torn from the sponge member during said contact adhere to the tip of the electrode causing irregular discharge. Because the sponge member presses from the direction of discharge, the tip of the plate electrode may become bent.

SUMMARY OF THE INVENTION

A main object of the present invention is to provide a cleaning device capable of simply and reliably cleaning the edges of a plate electrode having serrated edges.

Another object of the present invention is to provide a cleaning device for a charging device using a plate electrode, wherein said cleaning device does not damage itself during cleaning.

A further object of the present invention is to provide a cleaning device for a charging device using a plate electrode, wherein said cleaning device accomplishes said cleaning without deforming said plate electrode.

These and other objects of the present invention are accomplished by providing a charging device characterized by comprising a plate-like electrode provided with a plurality of protrusions, cleaning members provided bilaterally to said electrode and which grip said electrode therebetween to accomplish cleaning, and a guide member provided along the electrode so as to slidably guide the cleaning device thereon.

These and other objects of the present invention are accomplished further by providing a charging device characterized by comprising a plate-like electrode provided with a plurality of protrusions on its one end portion which confronts an image bearing member, cleaning members provided bilaterally to and along said electrode and which grip said electrode therebetween to accomplish cleaning, and a driving system which causes said cleaning members to grip said electrode only when said cleaning members are moved from a base toward an edge of the protrusions of said electrode.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DETAILED DESCRIPTION OF THE PREFERRED EMBODIMENTS

The preferred embodiments of the present invention are described hereinafter with reference to the accompanying drawings.

Figure 1:
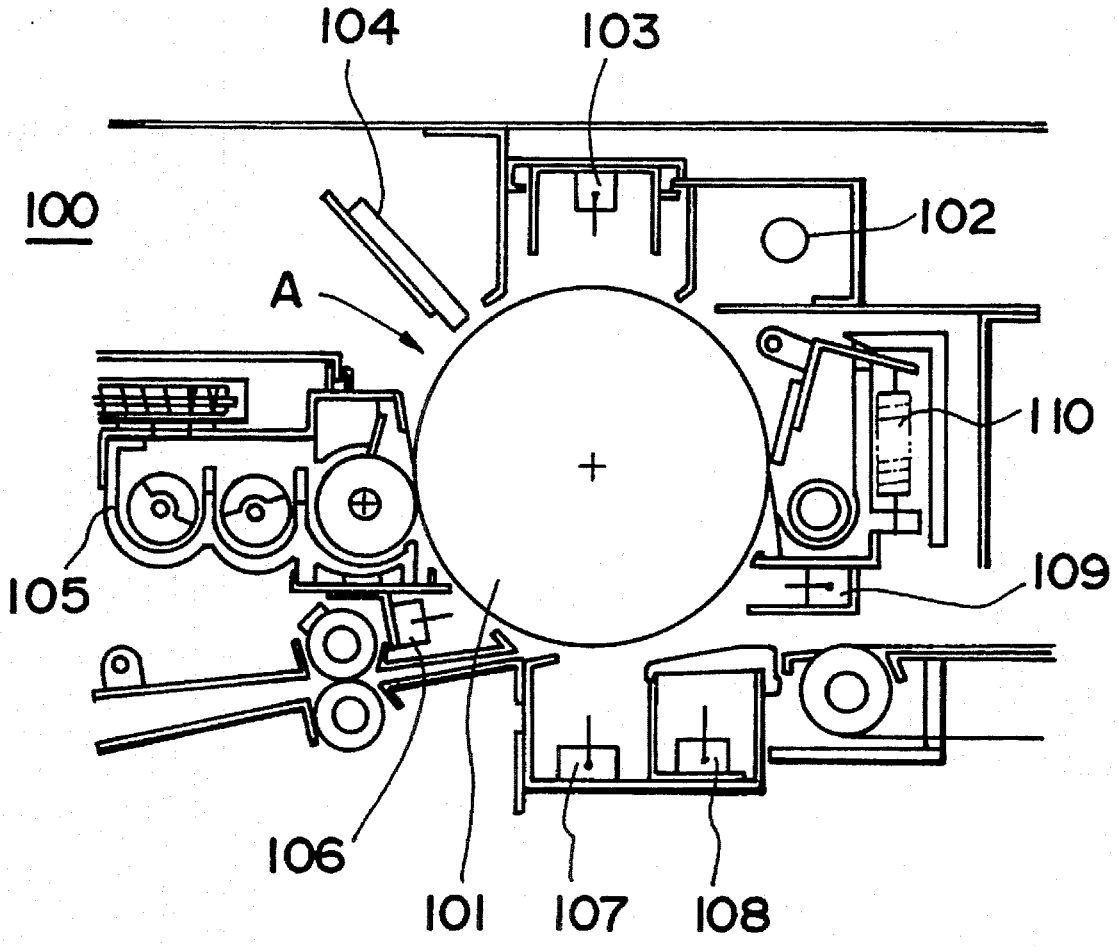
FIG. 1 is a section view showing an image forming section of an image forming apparatus of the present invention.

FIG. 1 is a section view showing the image forming section of an image forming apparatus 100 provided with a corona charging device of the present invention. The image forming section of the image forming apparatus 100 is provided a photosensitive member 101, around the periphery of which are sequentially arranged an eraser lamp 102, charger 103, image-interval/side eraser 104, developing device 105, pre-transfer charger 106, transfer charger 107, separation charger 108, precleaning charger 109, cleaning 110 and the like. Exposure occurs at point A. The corona charging device of the present invention comprises the aforesaid charger 103, pre-transfer charger 106, transfer charger 107, separation charger 108, precleaning charger 109.

Figures 2A, 2B:
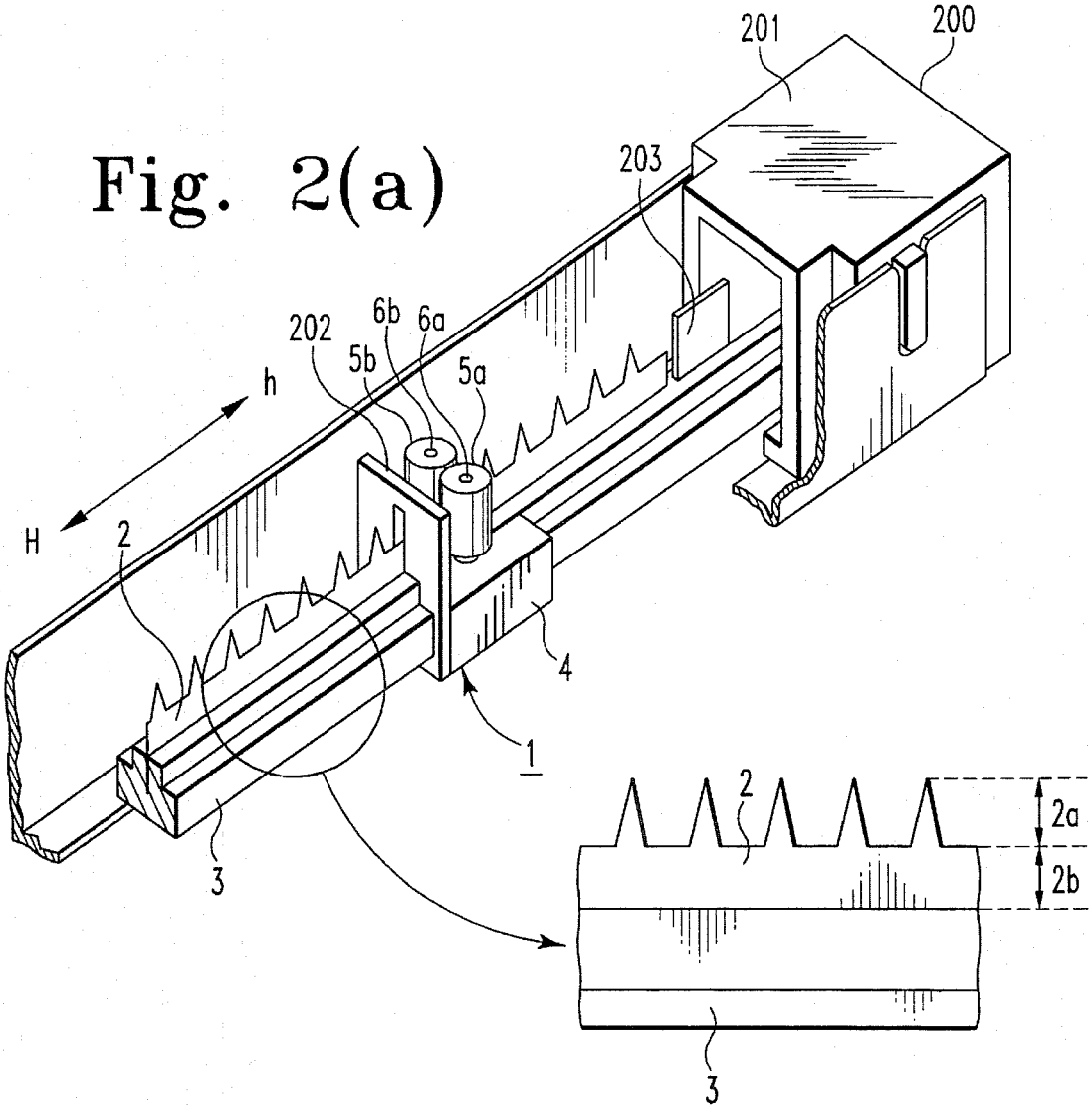
FIGS. 2(*a*) and 2(*b*) are perspective views showing a cleaning device of a corona charger of a first embodiment of the present invention.
Figure 3:
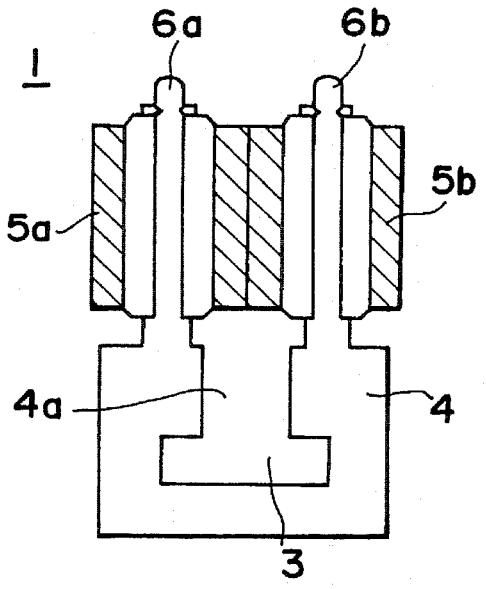
FIGS. 3(*a*) and 3(*b*) are section views of the cleaning device shown in FIG. 2.
Figure 3:
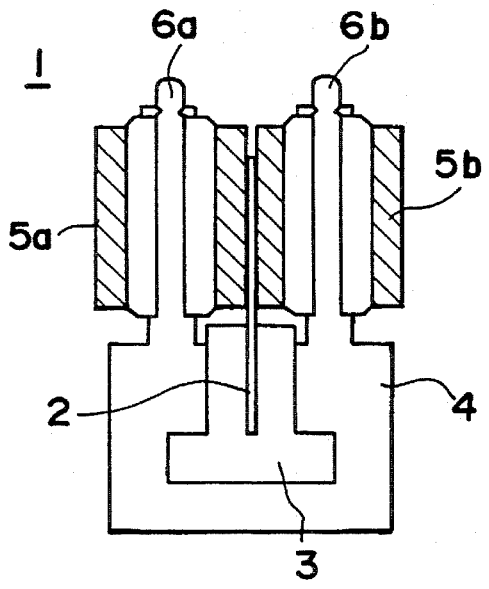

The corona charging device of the present invention is described in detail hereinafter with reference to FIGS. 2(*a*), 2(*b*) and 3(*b*). FIGS. 2(*a*) and 2(*b*) are perspective views of the corona charging device. FIG. 3(*a*) is a section view of the cleaning device 1, and FIG. 3(*b*) is a section view showing the cleaning device 1 installed in the corona charging device.

The corona charging device used by each of the aforesaid chargers is arranged lengthwise along axial direction of the photosensitive member 101, as shown in FIG. 1, and comprise a cleaning device 1 and a plate electrode 2 supported by holder 3, and a receiving section 200 for accommodating said cleaning device 1. The receiving section 200 is described later.

The plate electrode 2 comprises protrusions 2*a* and flat plate 2*b*. A part of the plate 2*b* is supported by being embedded in a holder 3. The length of the protrusions 2*a* indicated by the arrow in the drawing is 2 mm, whereas the length of the flat plate 2*b* is greater than 2 mm. The protrusions 2*a* are formed in a row with equidistant spacing; their pitch is 2 mm.

The cleaning device 1 removes the silicon (Si) and the like which adheres over time to the surface of the plate electrode 2. Furthermore, when the plate electrode 2 is not cleaned beforehand, the plate electrode 2 produces a charge irregularity. The cleaning device 1 comprises a movable member 4, and rotating shafts 6*a* and 6*b* and the like.

A channel 4*a* conforming to the T-shaped cross section of the holder 3 is provided on the movable member 4, such that the holder 3 engages the channel 4*a* and the movable member moves slidably in the arrow Hh direction with the holder 3 as a travel guide. Furthermore, rotating shafts 6*a* and 6*b* and a partition 202 are integratedly formed with the movable member 4.

The rotating shafts 6*a* and 6*b* are made of flexible material, and are each individually formed on a line perpendicular to the channel 4*a* on the side of the movable member 4 provided with said channel 4*a*. The rotating shafts 6*a* and 6*b* are arranged parallel to the tip of the protrusions 2*a* from the side of the plate electrode 2 embedded in the holder 3, so as to project farther than said protrusions 2*a*.

The rollers 5*a* and 5*b* are cleaning rollers provided so as to be rotatable on the rotating shafts 6*a* and 6*b*. The diameters of the rollers 5*a* and 5*b* and the distance between rotating shaft 6*a* and rotating shaft 6*b* are set so as to be in mutual contact when the plate electrode 2 is not connected. When the plate electrode 2 is connected between the rollers 5*a* and 5*b*, the space between said rollers 5*a* and 5*b* widens only the thickness of said plate electrode 2, and a force is exerted on the plate electrode 2 by the repulsion created by the elasticity of the rotating shafts 6*a* and 6*b*. The rollers 5*a* and 5*b* grip not only the protrusions 2*a* of the plate electrode 2, but also engage a part of the flat plate 2*b* (1.5 mm or more). Thus, sufficient friction force is produced between the plate electrode 2 and the rollers 5*a* and 5*b*, such that when an operator manually moves the cleaning device 1 in the arrow Hh direction, the rollers 5*a* and 5*b* are reversely rotated and the particles adhering to the surface of the plate electrode 2 such as silicon and the like are removed therefrom.

The materials of the rollers 5*a* and 5*b* are described below. The materials of the rollers 5*a* and 5*b* may be materials having elasticity such as rubber and the like, or hard materials such as resins, metals and the like. The tip of the plate electrode 2 may catch in the fine holes in the surface of the sponge, thereby causing deformation and fragments of the sponge member to be torn therefrom, such that the sponge fragments adhere to the tip of the plate electrode 2 and cause charge irregularities. Therefore, metal, resin, rubber or the like is preferred to sponge.

Hereinafter are considered differences in cleaning effectiveness in accordance with different materials for forming the rollers 5*a* and 5*b*. The results of cleaning tests using metal (SUS), resin (polyimide), and rubber (nylon) rollers, respectively, as the rollers 5*a* and 5*b* of the first embodiment are described below. The cleaning tests were conducted by controlling a constant current of −600 μA to apply a voltage to the plate electrode 2 during 100 hours of continuous discharge of said plate electrode 2 (equivalent to the time required to make 100,000 copies on A4-size sheets of horizontal orientation) to adhere silicon and the like on the plate electrode 2. Next, cleaning devices 1 provided with rollers 5*a* and 5*b* comprising each of the various previously mentioned materials was reciprocated to clean the plate electrode 2. Thereafter, the cleaned plate electrode 2 was used for charging, and a single sheet sample copy was made ar a current of −600 μA, and the noise ranking of said samples were studied. The number of reciprocations of the cleaning device 1 was variable at 0, 3, and 6 reciprocations with the tests otherwise conducted identically, and the sample noise rankings obtained by the individual tests were compared. The noise rankings express the degree of noise manifested in the image, and are expressed in four levels: double circle (◎), circle (○), triangle (Δ), and X. A double circle indicates no image irregularity; a circle indicates very slight image irregularity; a triangle indicates some image irregularity; and X indicates severe image irregularity.

The results of these cleaning tests are shown in Table 1.

TABLE 1

| Roller 5 material | No cleaning | 1 reciprocation | 3 reciprocations | 6 reciprocations |
|---|---|---|---|---|
| Metal (SUS) | X | ◎ | ◎ | ◎ |
| Resin (reduced PPO, polyimide) | X | ○ | ◎ | ◎ |
| Rubber (nylon) | X | Δ | ○ | ◎ |

◎: No image irregularity
○: Very slight image irregularity
Δ: Some image irregularity
X: Severe image irregularity As can be understood from Table 1, the noise rankings improve as the number of reciprocations of the cleaning device 1 increases using the rubber, resin, and metal materials, but a large noise rank improvement occurs when metal (SUS) rollers were used with 1 reciprocation cleaning. Thus, it can be said that among the previously mentioned various types of materials, it is desirable to use metal (SUS) rollers 5*a* and 5*b*.

Figure 4:
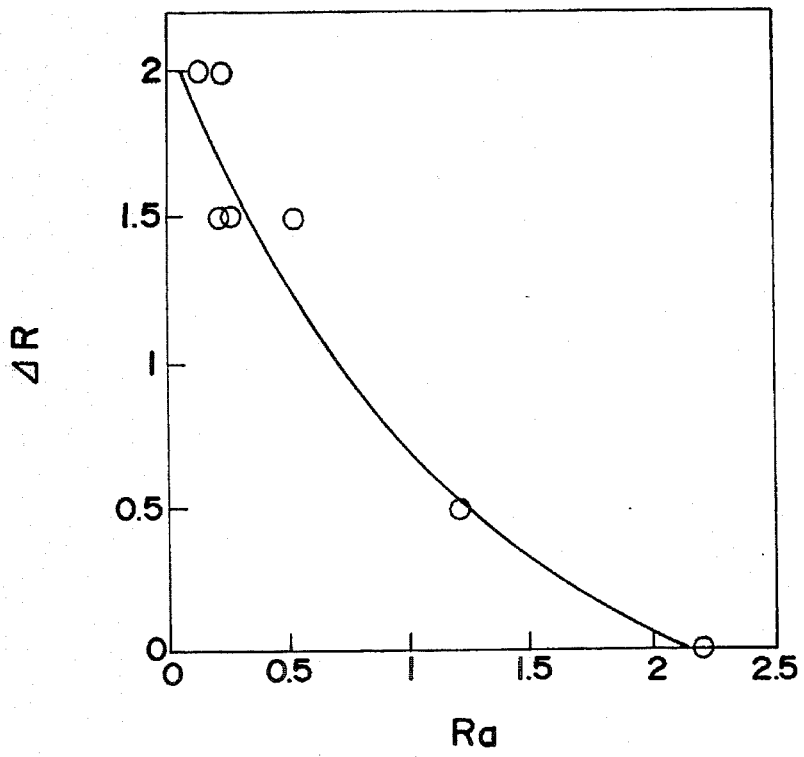
FIG. 4 is an illustration showing the relationship between the surface roughness of cleaning rollers of the cleaning device and the image irregularity recovery rank.

The conditions for the rollers 5*a* and 5*b* suitable for the cleaning device 1 of the present invention are expressed below for metal rollers 5*a* and 5*b*. FIG. 4 is an illustration showing the relationship between the surface roughness Ra of the rollers 5*a* and 5*b* and the image irregularity recovery rank ΔR. Tests to determine the aforesaid relationship were conducted by controlling a constant current of −600 μA to apply a voltage to the plate electrode 2 during 100 hours of continuous discharge of said plate electrode 2 (equivalent to the time required to make 100,000 copies on A4-size sheets), and image samples were obtained under conditions of silicon and the like adhering to the plate electrode 2. Next, the surface roughness Ra of the aforesaid plate electrode 2 was cleaned by one reciprocation of the cleaning device 1 provided with the rollers 5*a* and 5*b* of various surface roughnesses Ra, and the cleaned plate electrode 2 was used for charging to obtain image samples. Image samples obtained both before and after the aforesaid cleaning were compared, noise rank recoveries were studied. The degree of noise is expressed as noise rankings by the numerical values 1~5. Increasing noise, indicating worsening image quality, is rated by decreasing numerical value from 5 to 1. Normal halftone images are rated up to rank 3 which presents no problem from a practical standpoint. Character images are ranked up to rank 2 without image noise such as white streaks and the like, and present no problem from a practical standpoint.

The image irregularity recovery rank ΔR expresses the difference between the pre-cleaning and post-cleaning noise ranks, e.g. , if the pre-cleaning noise rank is 4 and the post-cleaning noise rank is 2, the image irregularity recover rank ΔR is 2. The pre-cleaning noise ranks all were below rank 3. The surface roughness Ra of the rollers 5*a* and 5*b* were measured by a tracer type surface roughness tester as the rollers 5a and 5b were rotating. The plot points shown in the illustrations were recorded after the third reciprocation of the cleaning device 1. It can be understood from FIG. 4 that cleaning is effective (image irregularity recovery rank ΔR value increases) when the surface roughness Ra of the rollers 5a and 5b is about 2 or less. It is desirable in practice that the image irregularity recovery rank ΔR is ≧0.5, and the surface roughness Ra of the rollers 5a and 5b is 1.25. Ideally, the image irregularity recovery rank ΔR is ≧1.0, and the surface roughness Ra of the rollers 5a and 5b is ≦0.75.

Figure 5:
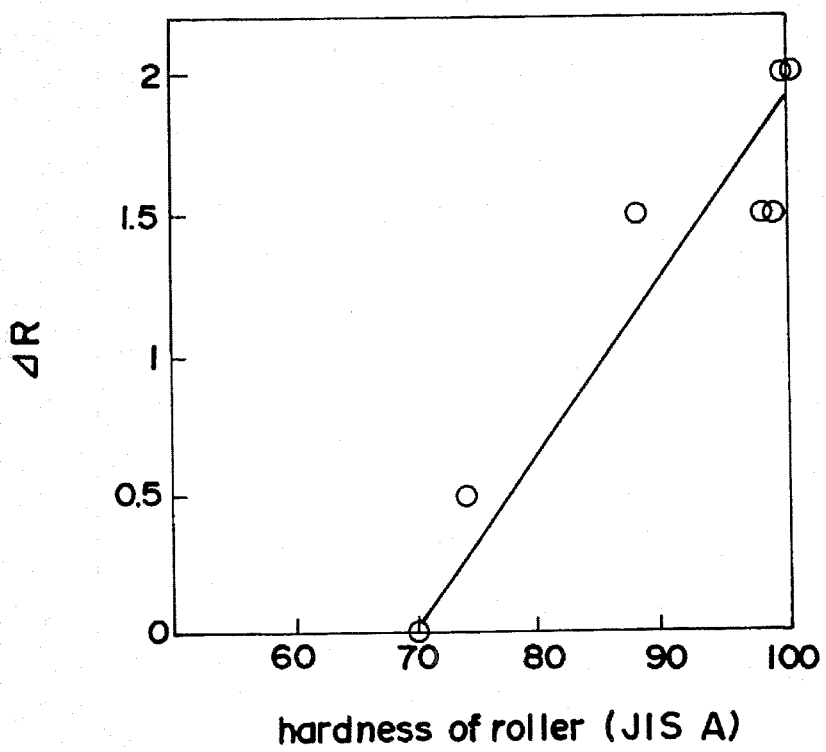
FIG. 5 is an illustration showing the relationship between the hardness of the cleaning rollers and the image irregularity recovery rank.

FIG. 5 shows the relationship between the hardness JISA of the rollers 5a and 5b and the image irregularity recovery rank ΔR (same as FIG. 4). The hardness JISA of the rollers 5a and 5b was measured using a Japanese Industrial Standards (JIS) constant load device. As can be understood from FIG. 5, cleaning is effective when the hardness JISA of the rollers 5a and 5b is ≧70°. In practice, the image irregularity recovery rank ΔR is ≧0.5, and the hardness JISA of the rollers 5a and 5b is preferably ≧80°, and ideally ≧85°.

Figure 6:
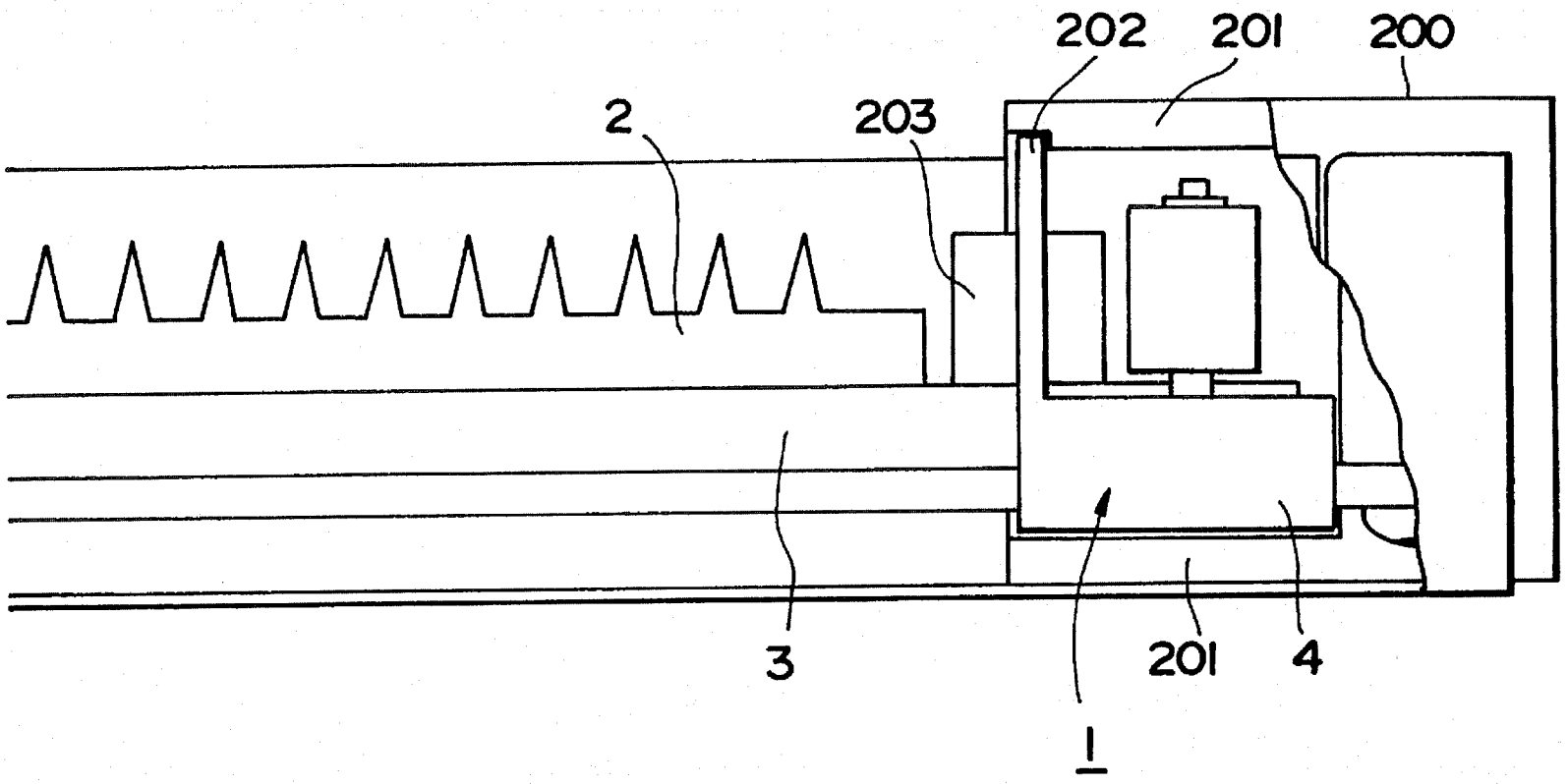
FIG. 6 is an illustration showing the cleaning device accommodated in a receiving section.
Figure 7:
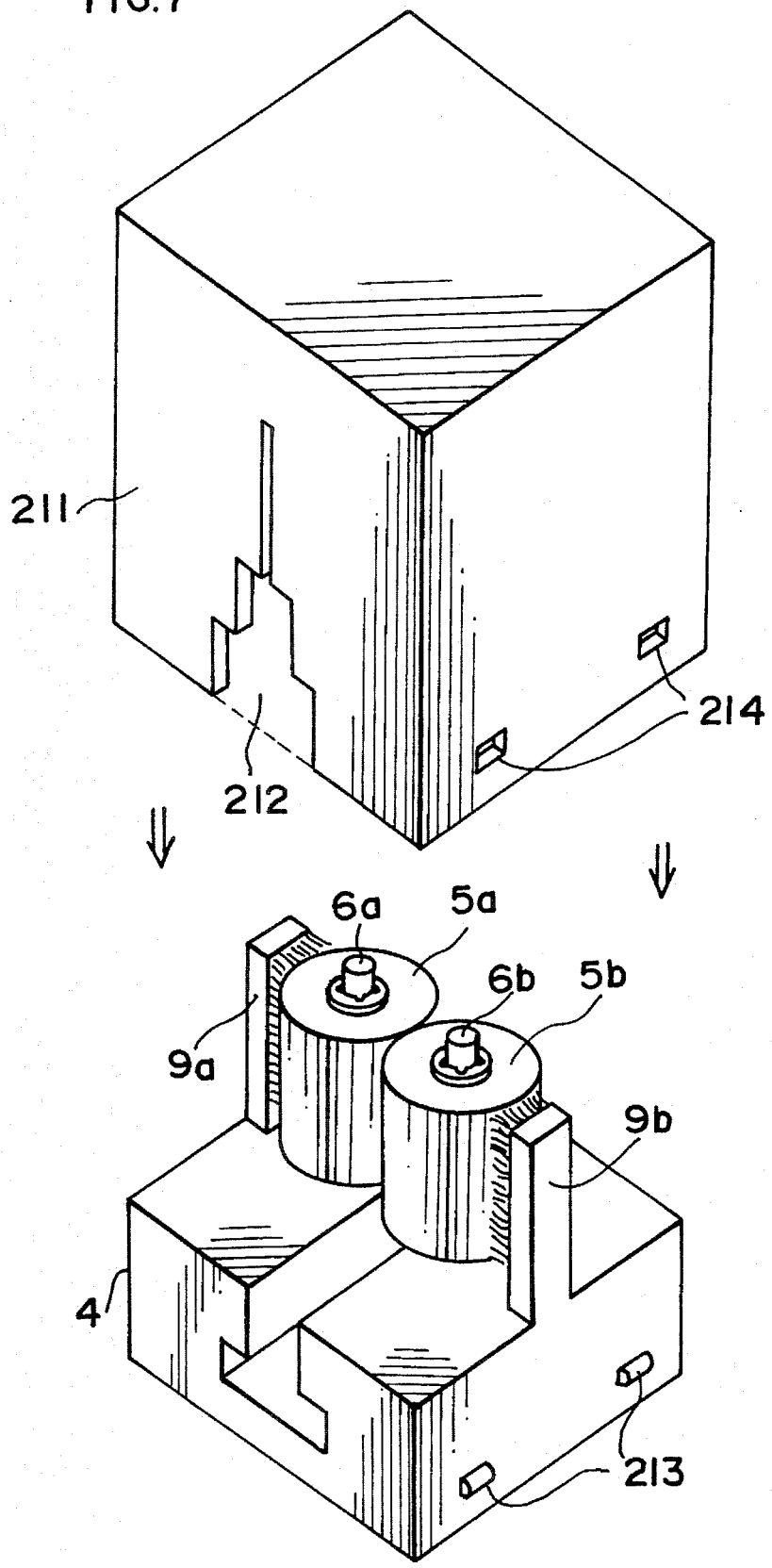
FIG. 7 is a perspective view showing a cover of the cleaning device.

The receiving section 200 for accommodating the cleaning device 1 is described hereinafter with reference to FIGS. 2 and 6. FIG. 6 shows the cleaning device 1 accommodated in the receiving section 200. The receiving section 200 accommodates the cleaning device 1 and shields said cleaning device 1 from the discharge region during discharge by the plate electrode 2. When the cleaning device 1 is exposed during the discharge by the plate electrode 2, said cleaning 1 is soiled by the gases ($O_3$, $NO_x$, and the like), toner debris, and dust generated during corona discharge, such that over time the cleaning effectiveness is reduced. The receiving section 200 is arranged at the end of the corona charger in the lengthwise direction, so as to be outside the discharge region of the plate electrode 2. The receiving section 200 comprises a frame 201 and a partition 202. The frame 201 is box-shaped with an opening provided only on the face opposite the plate electrode 2. The partition 202 engages the aforesaid opening so as to shield the cleaning device 1 from the discharge region of the plate electrode 2. The partition 202 is provided as a part of the movable member 4, and moves integratedly with the cleaning device 1, and engages the opening of the frame 201 when the cleaning device 1 is accommodated in the receiving section 200. The partition 202 is provided with an opening which conforms to the shapes of the plate electrode 2 and holder 3 so as to avoid hindering the movement of the cleaning device 1 traveling along the plate electrode 2. When the cleaning device 1 is accommodated in the receiving section 200, a plate-shaped member 203 engages the aforesaid opening and fills the space of said opening, so as to prevent the entrance of gasses ($O_3$, $NO_x$, and the like), toner debris, and dust during corona discharge in the discharge region. When the cleaning device 1 is accommodated in the receiving section 200, the rollers 5a and 5b do not come into contact with the plate-shaped member 203. Such an arrangement reduced the load on the rollers 5a, 5b, and rotating shafts 6a and 6b, thereby increasing the service life of said components. The plate-shaped member 203 is disposed on a prolonged line in the lengthwise direction of the plate electrode 2, and has a thickness and height in the direction of the protrusions identical to that of the plate electrode 2.

The receiving section 200 may be provided at both ends of the corona charger. The receiving section 200 may be constructed as a part of the frame for the corona charger, and may be constructed as part of the body of the image forming apparatus.

Alternatively, a box-shaped cover 211 may be provided in substitution for the aforesaid receiving section 200, so as to cover the rollers 5a and 5b mounted on the movable member 4. The cover 211 is provided with an opening 212 which conforms to the shapes of the plate electrode 2 and holder 3. The cover 211 is mounted by inserting the concavities 214 on the side of the cover 211 onto the convexities 213 on the side of the movable member 3. When the cleaning device 1 is covered by the aforesaid box-shaped frame, the rollers 5a and 5b are protected from scattered toner and dust during cleaning.

Modifications of the first embodiment are described hereinafter.

Figure 8A:
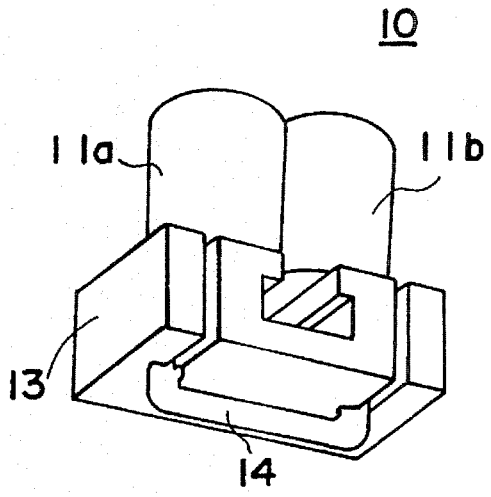
FIGS. 8(*a*), 8(*b*) and 8(*c*) are illustrations showing a cleaning device of a first modification of the first embodiment.
Figure 8B:
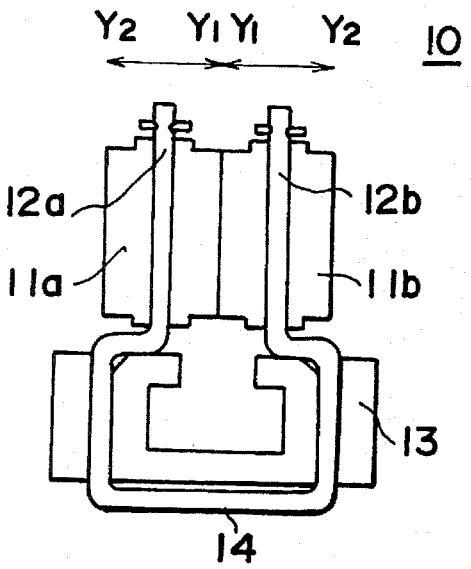
Figure 8:
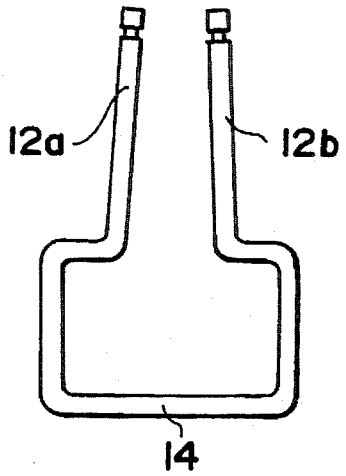

The cleaning device 10 of a first modification of the first embodiment is described below with reference to FIGS. 8(*a*)~(*c*). FIG. 8(*a*) is a perspective view of the cleaning device 10, FIG. 8(*b*) is a section view of the cleaning device 10, and FIG. 8(*c*) shows the rotating shafts 12a and 12b. The cleaning device 10 comprises rollers 11a and 11b and their respective rotating shafts 12a and 12b, and movable member 13 as individual components. The rotating shafts 12a and 12b are integrated as a part of the elastic member 14, and the free ends of said rotating shafts 12a and 12b are mutually inclined toward the tips of the protrusions 2a. The cleaning device 10 is constructed so as to be inserted into a channel provided in the movable member 13. When the rollers 11a and 11b mare inserted on the rotating shafts 12a and 12b, the tips of the rotating shafts 12a and 12b are expanded in arrow Y2 direction via the thickness of the rollers 11a and 11b. In opposition to this, the rollers 11a and 11b exert a force so as to grip the plate electrode 2 with constant force via the spring force of the elastic member 14 working in the arrow Y1 direction. The result is the rollers 11a and 11b are prevented from rising from the plate electrode 2, and clean the plate electrode 2 reliably. The aforesaid force is regulated by the diameters of the rollers 11a and 11b, the spacing of the rotating shafts 12a and 12b, the inclination of the rotating shafts 12a and 12b, and the spring force of the elastic member 14. Furthermore, a tension spring may be interposed between both tips of the rotating shafts 12a and 12b, such that the rollers 11a and 11b grip the plate electrode 2 with constant force.

Figure 9:
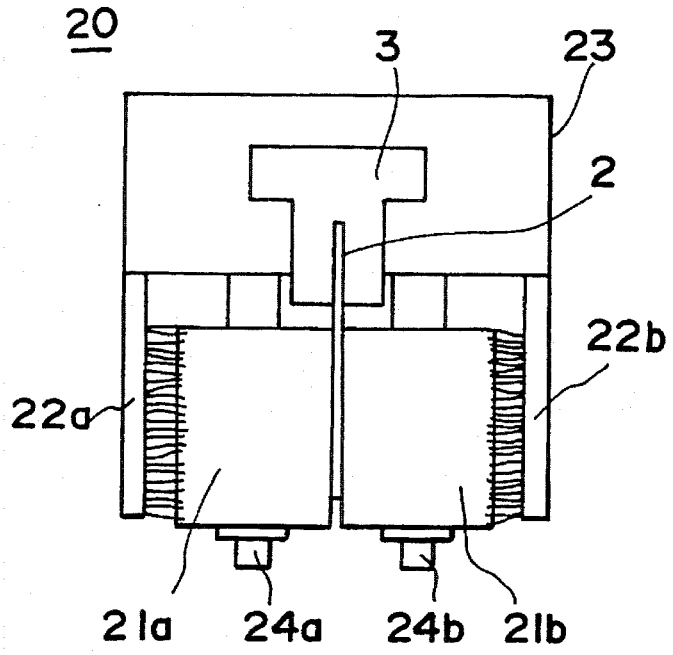
FIGS. 9(*a*) and 9(*b*) are illustrations showing a cleaning device provided with brushes of a second modification of the first embodiment.
Figure 9:
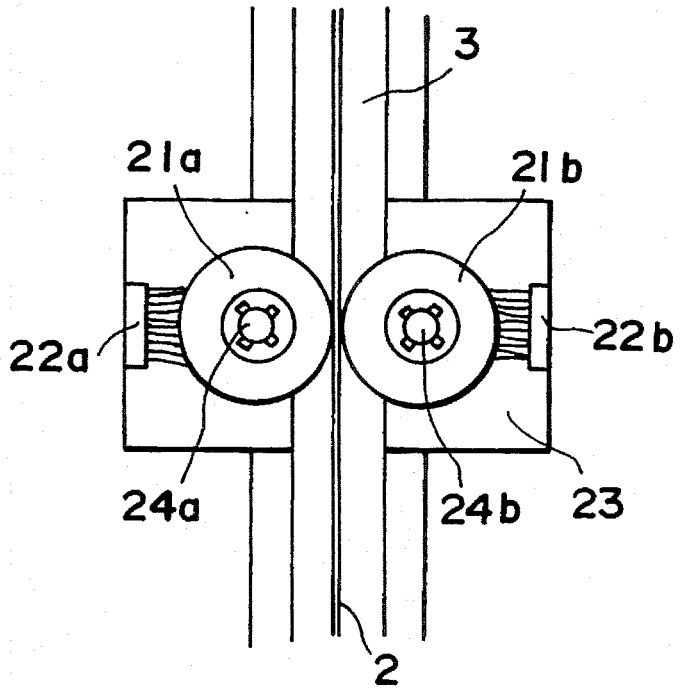

A second modification of the first embodiment, cleaning device 20 provided with members for cleaning the surface of rollers 21a and 21b, is described hereinafter with reference to FIGS. 9(*a*) and 9(*b*). FIG. 9(*a*) is a side view of cleaning device 20, FIG. 9(*b*) is a bottom view of cleaning device 20. The cleaning device 20 comprises rollers 21a and 21b, brushes 22a and 22b for cleaning the surface of said rollers 21a and 21b, movable member 23, rotating shafts 24a and 24b. The brushes 22a and 22b are mounted on both ends of the movable member 23 with the brush facing the interior and along the rollers 21a and 21b, such that the brush surface is in contact with the surfaces of the rollers 21a and 21b. The brushes 22a and 22b remove silicon (Si) and the like adhering to the surface of the rollers 21a and 21b in conjunction with the rotation of rollers 21a and 21b. Thus, the surfaces of the rollers 21a and 21b are normally refreshed, and maintain the cleaning effectiveness over the long term whenever the plate electrode 2 is cleaned.

Figure 10A:
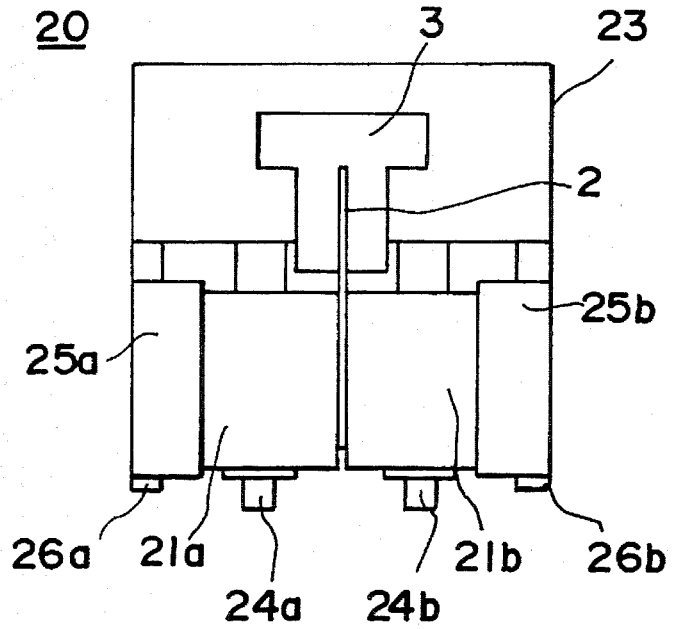
FIGS. 10(*a*) and 10(*b*) are illustrations showing the cleaning device 20 provided with flickers of the second modification.
Figure 10B:
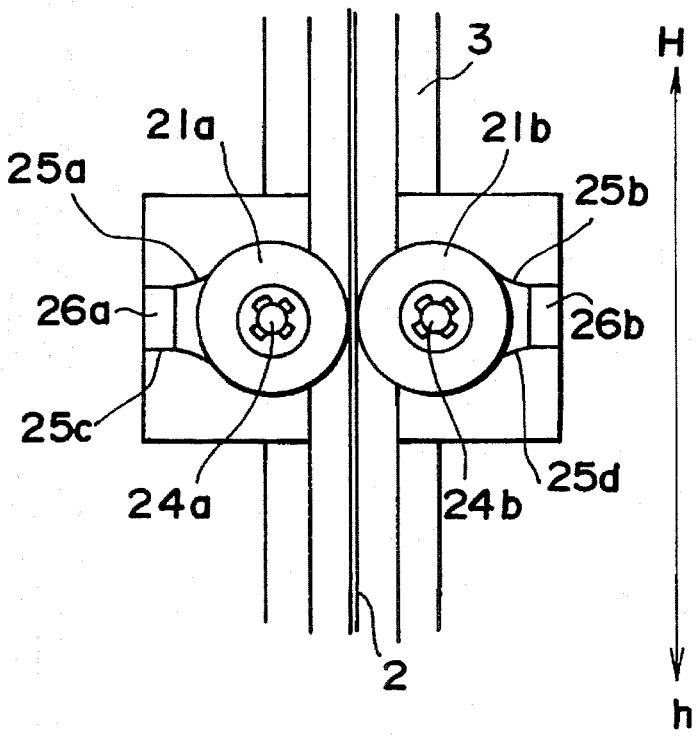

As shown in FIGS. 10(*a*) and 10(*b*), flickers 25a~25d may be used instead of the brushes 22a and 22b to clean the rollers 21a and 21b. FIG. 10(*a*) is a side view of the cleaning device 20, and FIG. 10(*b*) is a bottom view of the cleaning device 20. The flickers 25a~25d comprise flexible sheets mounted via columnar mounting members 26a and 26b disposed at the same positions as the brushes 22a and 22b shown in FIGS. 9(*a*) and 9(*b*) on the movable member 23. One edge of the flicker 25a is adhered to the end face of the mounting member 26*a* on the arrow H direction side, i.e., the direction of travel of the cleaning device 20; one edge of the flicker c is adhered to the end face of the mounting member 25*a* on the arrow h direction side. One edge of the flickers 26*b* and 25*d* are similarly adhered to both sides of the mounting member 26*b* relative to the travel direction of the cleaning device 20. The other edges of the flickers 25*a*~25*d* are unattached and are in a state of contact with the surfaces of the rollers 21*a* and 21*b*. The length in a direction perpendicular to the holder 3 of the flickers 25*a*~25*d* is longer than the distance from the mounting members 26*a* and 26*b* to the surface of the rollers 21*a* and 21*b*, such that said supported flickers 25*a*~25*d* are bent.

The cleaning device 20 moves reciprocally in the arrow Hh directions via manual manipulation by an operator. The cleaning device 20 is provided with 2 sets of flickers 25*a*, 25*b* for cleaning by removing the adhered debris from the surface of the rollers 21*a* and 21*b* when the device is moved in the arrow h direction, and flickers c, 25*d* for cleaning when the device is moved in the arrow H direction.

The particles of silicon (Si) and the like adhered to the plate electrode 2 are charged by the application of a high voltage (several kilovolts) of either positive or negative polarity to the plate electrode 2. When the adhered particles are charged, it is difficult to remove said particles from the plate electrode 2 due to the force of electrostatic attraction. Therefore, the rollers 21*a* and 21*b*, or brushes 22*a* and 22*b* (or flickers 25*a*~25*d*) are made of electrically conductive material, such that the cleaning effectiveness of the brushes 22*a* and 22*b*, or flickers 25*a*~25*d* can be improved by discharging the electrical charge of said adhered particles by grounding or applying a bias voltage (alternating or direct current).

Figure 11:
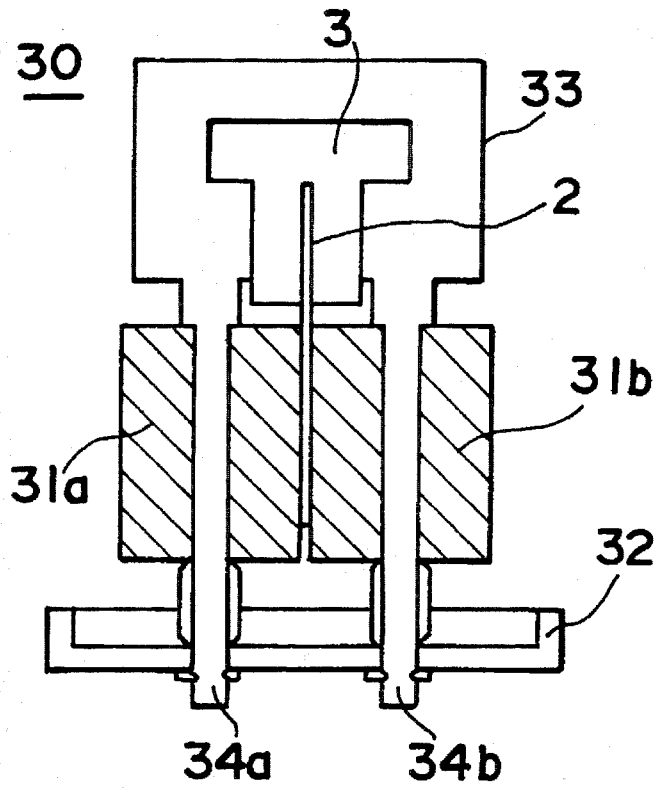
FIG. 11 is a section view showing the cleaning device of a third modification of the first embodiment.

A third modification of the first embodiment is cleaning device 30 provided with members for collecting the adhered debris removed during cleaning. FIG. 11 is a section view of the cleaning device 30. Cleaning device 30 is provided with a receiving plate 32 for receiving the adhered particles of silicon removed from the plate electrode 2 by the rollers 31*a* and 31*b*. Rotating shafts 34*a* and 34*b* are formed integratedly with the movable member 33 and extend below the rollers 31*a* and 31*b*, said receiving plate 32 being mounted at the tip of the rotating shafts 34*a*, 34*b*. The cleaning device 30 uses a corona charger (charger 103) provided above the photosensitive member 101 within the corona charging device shown in FIG. 1.

Figure 12:
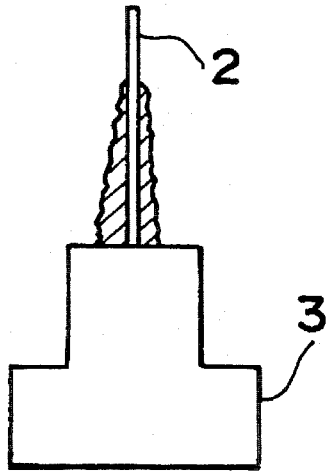
FIG. 12 is a section view of a plate electrode showing toner deposits and the like accumulated near the mounting of the plate electrode and a holder.

A fourth modification of the first embodiment is cleaning device 40 provided with members for cleaning the flat plate 2*b* of the plate electrode 2. As shown in FIG. 12, toner and the like accumulates bilaterally on the flat plate 2*b* in the vicinity of the mounting between the holder 3 and the plate electrode 2. The accumulated materials includes toner spilled from the developer 105 and cleaner 120, and paper dust generated from paper transported to the image forming section. The accumulated materials, if left as is, cause uneven rotation of the rollers 43*a* and 43*b* provided in the cleaning device 40, so as to bend the plate electrode 2. Unlike the cleaning device 30 of the third modification, the cleaning device 40 is particularly effective when provided below the photosensitive member 101 where toner readily accumulates for use in the pre-transfer charger 106, transfer charger 107, separation charger 108, pre-cleaning charger 109 and the like.

Figure 13A:
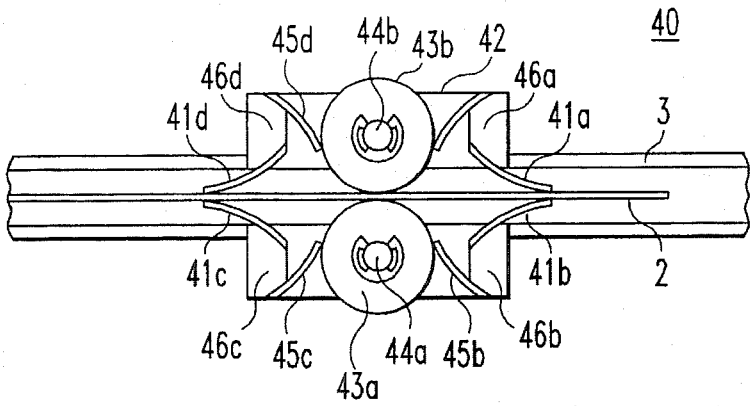
FIGS. 13(*a*), 13(*b*) and 13(*c*) are illustrations showing the construction of a cleaning device of a forth modification of the first embodiment.
Figure 13B:
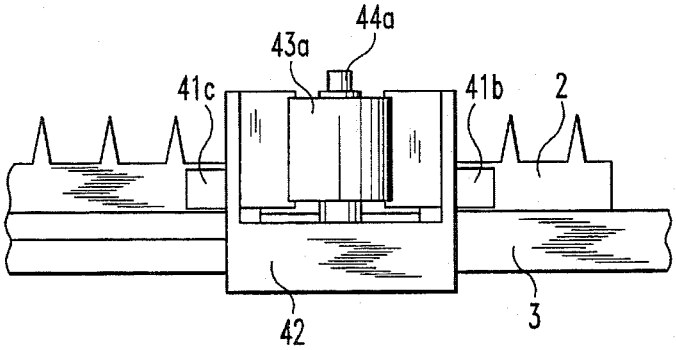
Figure 13C:
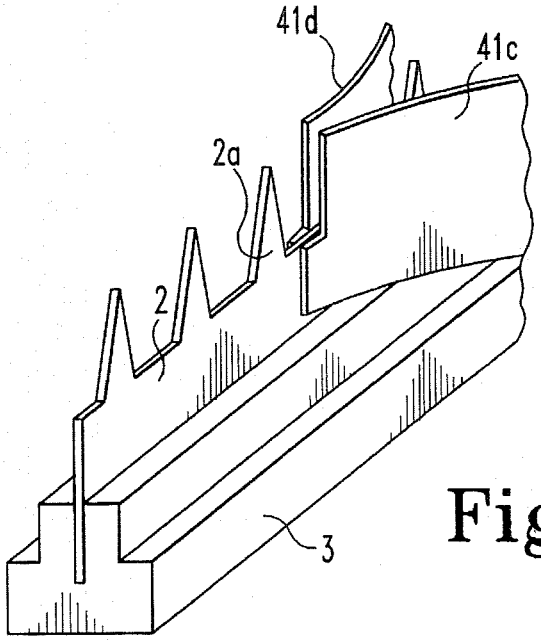

FIG. 13(*a*) is a top view of the cleaning device 40; FIG. 13(*b*) is a side view of the cleaning device 40. FIG. 13(*c*) is a perspective view showing the scraping members 41*a* and 41*c* for cleaning the flat plate 2*b*.

The cleaning device 40 comprises scraping members 41*a*~41*d*, movable member 42, rollers 43*a* and 43*b*, rotating shafts 44*a* and 44*b*, flickers 45*a*~45*d* for cleaning the surface of said rollers 43*a* and 43*b*, and mounting members 46*a*~46*d* for holding the scraping members 41*a*~41*d* and flickers 45*a*~45*d*.

The scraping members 41*a*~41*d* and flickers 45*a*~45*d* are made of flexible sheets, one end of which is adhered to mounting members 46*a*~46*d*, respectively, and the other end of which is unattached.

The mounting members 46*a*~46*d* are columnar members integratedly formed with the movable member 42, and which grip the plate electrode 2 at both ends of the movable member in the directions of reciprocating movement. The mounting members 46*a*~46*d* are four rectangular columns arranged so as to be respectively aligned at a single angle of the movable member 42 at the previously mentioned position, thereby forming a beveled configuration of two angular sides relative to the respective rollers 43*a* and 43*b*. Among the two beveled surfaces of the mounting members 46*a*~46*d*, the scraping members 41*a*~41*d* are adhered to one surface opposite the plate electrode 2, whereas one end of the flickers 45*a*~45*d* are adhered to the exterior surface.

The scraping members 41*a*~41*d* are arranged such that the unattached ends thereof face the exterior side of the movable member 42 so as to make pressure contact with the flat plate 2*b* bilaterally on the plate electrode 2 at a position anterior to the rollers 43*a* and 43*b* in the direction of advance of the cleaning device 40. The scraping members 41*a*~41*d* do not make contact with the protrusions 2*a* of the plate electrode 2. Furthermore, brushes or the like may be used instead of the aforesaid scraping members 41*a*~41*d*. If the scraping members 41*a*~41*d* are constructed of electrically conductive materials, cleaning effectiveness of the scraping members 41*a*~41*d* may be improved by discharging the accumulated materials via grounding or applying a bias voltage (AC or DC).

The unattached ends of the flickers 45*a*~45*d* are arranged to face the center of the movable member 42 so as to be in contact with the rollers 43*a* and 43*b*, and thereby clean the accumulated materials of toner and the like adhered to the surface of the rollers 43*a* and 43*b* via the rotation of said rollers 43*a* and 43*b*.

A second embodiment of the corona charging device of the present invention is described hereinafter. The second embodiment of the corona charging device of the present invention is provided with a cleaning device 50 having a pari of brush rollers 51*a* and 51*b* described later instead of the rollers 5*a* and 5*b* provided in the cleaning device 1 of the previously described first embodiment. Compared to the cleaning device 1 of the first embodiment, the cleaning device 50 has excellent effectiveness in removing adhered materials other than silicon, especially toner and paper particles, by using a pair of brush rollers 51*a* and 51*b*. The cleaning device 50 is extremely effective not only in the charger 103 shown in FIG. 1, but also in charger which tend to accumulate a large quantity of toner adhering on the plate electrode 2, such as the pre-transfer charger 106, transfer charger 107, separation charger 108, pre-cleaning charger 109 and the like.

Figure 14:
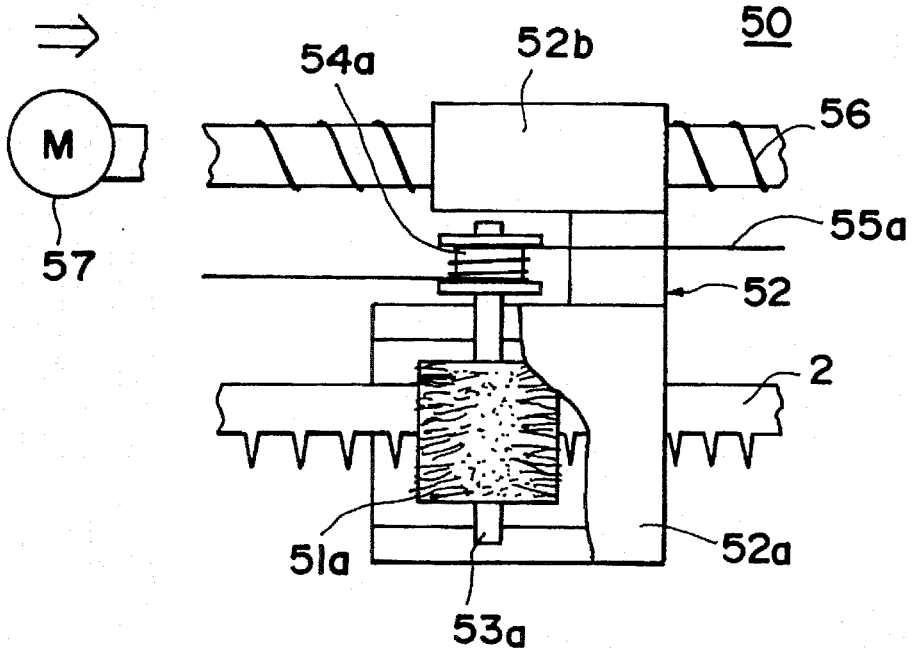
FIG. 14 is a partial section view of a cleaning device of a second embodiment.
Figure 15:
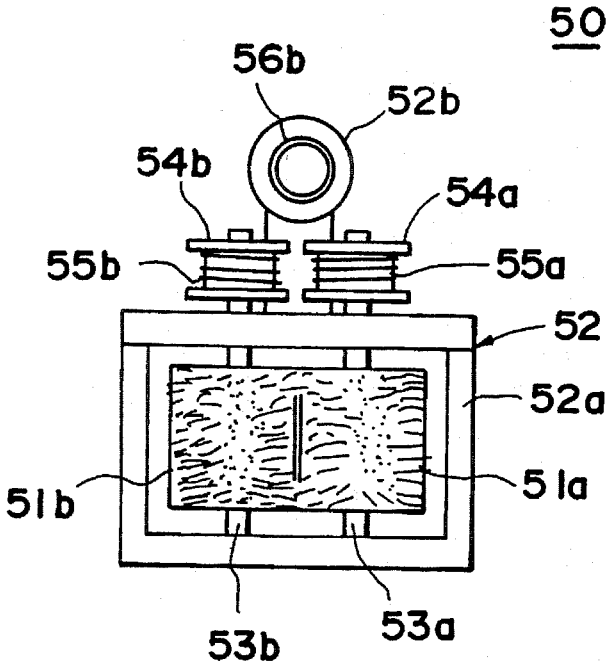
FIG. 15 is a side view of a cleaning device of FIG. 14 viewed from the arrow direction.

The construction and cleaning operation of the cleaning device 50 provided in the corona charging device of the second embodiment is described hereinafter. FIG. 14 is a partial cross section view showing the construction of the cleaning device 50. FIG. 15 is a side view of the cleaning device 50 viewed from the arrow direction of FIG. 14.

The cleaning device 50 comprises a pair of brush rollers 51*a* and 51*b* which grip and clean the plate electrode 2, movable member 52 supports said brush rollers 51*a* and 51*b* and is arranged so as to be reciprocally movable in the length direction of the plate electrode 2, and a drive mechanism for driving the movable member 52 and rotating the brush rollers 51*a* and 51*b*.

The brush rollers 51*a* and 51*b* have nylon brushes with a follicle diameter of 28 μm and follicle length of 3 mm provided on the surface of a roller 4 mm in diameter, and a follicle density of 1,000 follicles/cm$^2$. The distance from the center of rotation of the brush rollers 51*a* and 51*b* to the side surface of the plate electrode 2 is 1 mm shorter than the radius (5 mm) of the brush rollers 51*a* and 51*b*. The difference between the radius of the brush rollers 51*a* and 51*b* and the distance from the center of rotation of said rollers 51*a* and 51*b* to the side surface of the plate electrode 2 is designated the amount of offset.

The movable member 52 comprises a frame 52*a* having openings provided in the directions of both ends of the plate electrode 2, and connector 52*b* for connecting to the drive mechanism described later and receiving the drive force output from said drive mechanism. The drive mechanism comprises a screw member 56, motor 57, pulleys 54*a* and 54*b*, wires 55*a* and 55*b* and the like, and said drive mechanism drives the movable member 52 and rotates the brush rollers 51*a* and 51*b*.

Within the frame 52*a* of the movable member 52, the brush rollers 51*a* and 51*b* are arranged so as to grip the plate electrode 2 via the respective rotating shafts 53*a* and 53*b*. The rotating shafts 53*a* and 53*b* are arranged such that one end engages a concavity provided in the frame 52*a* so as to be rotatable, the other end protrudes from said frame 52*a*. Pulleys 54*a* and 54*b* are mounted on the ends of the rotating shafts 53*a* and 53*b* protruding from the frame 52*a*. Wires 55*a* and 55*b* are reeved around the pulleys 54*a* and 54*b*, and both ends of said wires 55*a* and 55*b* are fixedly attached to side walls of the holder of the corona charging device not shown in the drawing.

On the other hand, the connector 52*b* of the movable member 52 is cylindrical in shape with an opening in the center, as shown in FIG. 15, and a screw channel 56*b* is provided on the interior side thereof. A screw member 56 spirals parallel to the plate electrode 2 in the screw channel 56*b* provided in the aforesaid connector 52*b*. When the screw member 56 is rotatably driven by motor 57 and gears (not illustrated), the movable member, i.e., the cleaning device 50 is moved in the lengthwise direction of the plate electrode 2, the pulleys 54*a* and 54*b* rotate so as to rotate the roller brushes 51*a* and 51*b*. The cleaning device 50 is reciprocally movable in the lengthwise direction of the plate electrode 2 by switching the rotational direction of the screw member 56.

In accordance with the movement of the movable member 52 via the rotation of the screw member 56, the pulleys 54*a* and 54*b* around which are reeved the wires 55*a* and 55*b* are rotated, thereby rotating the brush rollers 51*a* and 51*b* mounted on the rotating shafts 53*a* and 53*b*. Thus, the cleaning device 50 cleans the plate electrode 2 while moving in the lengthwise direction of said plate electrode 2 via the rotation of said screw member 56.

Figure 16A:
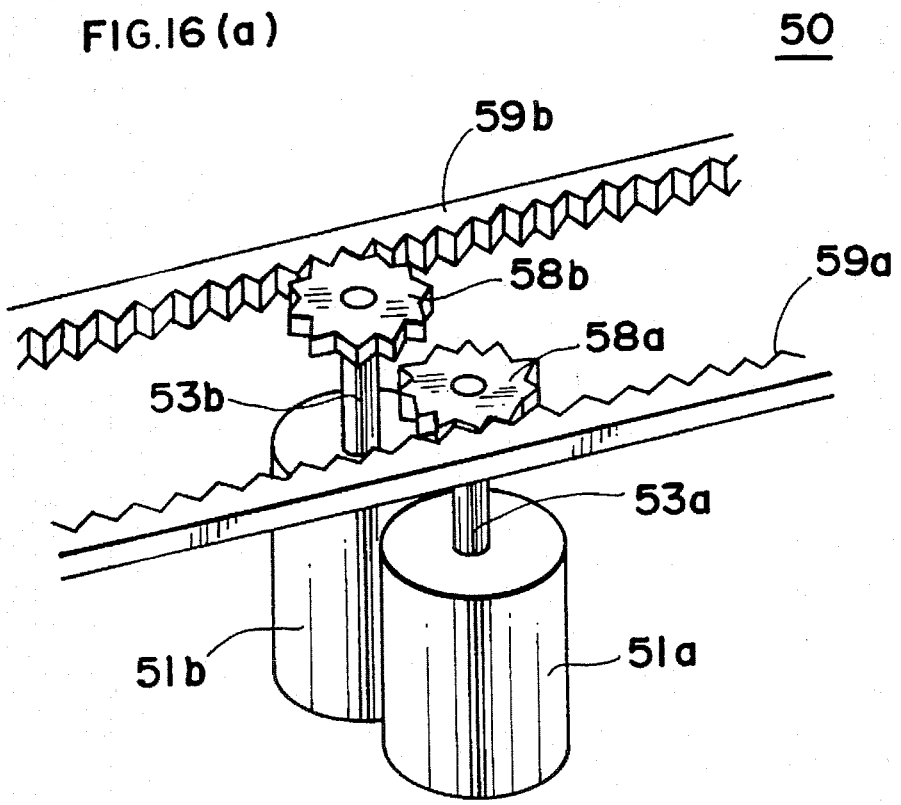
FIGS. 16(*a*) and 16(*b*) are illustrations of modifications of a drive mechanism for rotating brush rollers of FIG. 14.
Figure 16B:
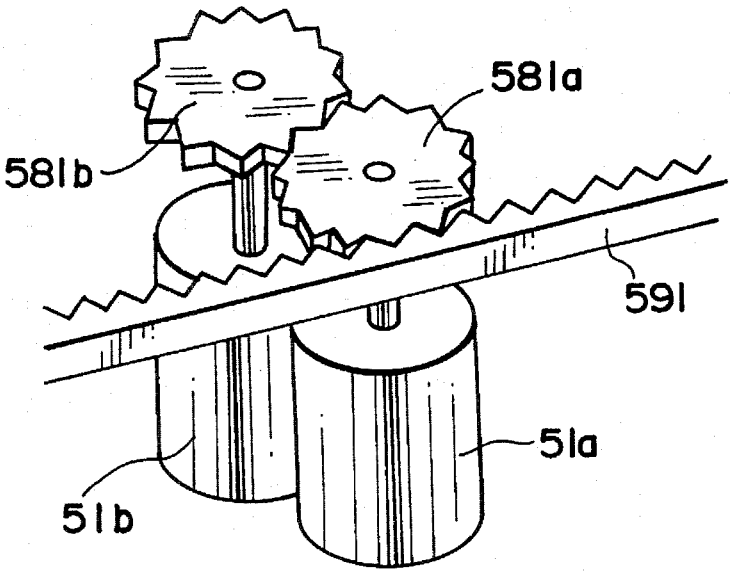

The previously described drive mechanism may be such as that shown in FIGS. 16(*a*) and 16(*b*), or may have another configuration that is not illustrated. The drive mechanism shown in FIG. 16(*a*) provides gears 58*a* and 58*b* instead of the aforesaid pulleys 56*a* and 56*b*, said gears 58*a* and 58*b* respectively engaging racks 59*a* and 59*b*. Although not shown in FIG. 16(*a*), the gears 58*a* and 58*b* which engage the racks 59*a* and 59*b* are rotated via the horizontal movement of the movable member 52 in the lengthwise direction of the plate electrode 2, thereby rotating the rotating shafts 53*a* and 53*b* connected to the center of said gears 58*a* and 58*b*, i.e., rotating the brush rollers 51*a* and 51*b*. The drive mechanism shown in FIG. 16(*b*) is provided with gears 581*a* and 581*b* which mutually engage, said gear 581*a* also engages rack 591, such that said gear 581*a* is rotated when engaged with said rack 591 via the horizontal movement of the cleaning device 50, thereby rotating the gear 581*b* in the opposite direction to the rotation of the gear 581*a* via the rotation of said gear 581*a*. When this type of drive mechanism is used, the cleaning device 50 achieves a similar action and cleaning effectiveness.

The various setting to improve cleaning effectiveness of the cleaning device 50 are considered hereinafter.

1. Rotational speed of brush rollers 51*a*, 51*b*

Figure 17:
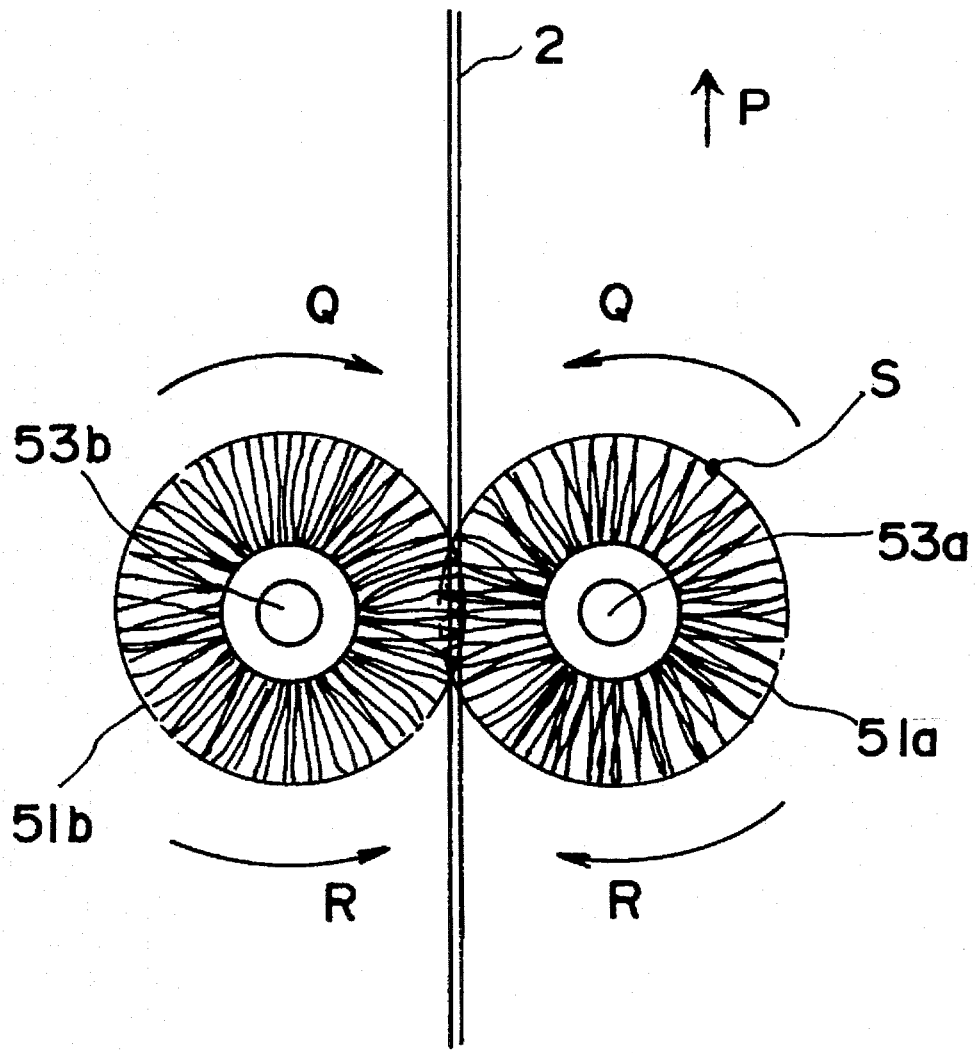
FIG. 17 is an illustration describing the rotational directions of the brush rollers.

First the rotational speeds of the brush rollers 51*a* and 51*b* are examined below. Specifically, the speed ratios of the rotational speed of the brush rollers 51*a* and 51*b* and the movement speed of the movable member 52, i.e., rotational speed/movement speed, were variously changed and cleaning effectiveness was compared. The rotational speed of the brush rollers 51*a* and 51*b* is the speed at which a point S on the tip of the brush moves on the exterior surface of the brush rollers 51*a* and 51*b* per unit time, as shown in FIG. 17. These experiments were conducted by controlling a constant current of −600 μA to apply a voltage to the plate electrode 2 during 100 hours of continuous discharge of said plate electrode 2, and after toner was adhered to the entirety of the plate electrode 2 and severe image irregularities were produced, the cleaning member 50 of the aforesaid construction was used to clean the plate electrode 2. The rotational speed of the brush rollers 51*a* and 51*b* was varied by varying the size of the pulleys 54*a* and 54*b*.

Cleaning was accomplished by changing the number of reciprocations of the cleaning device 50, i.e., 1 reciprocation and 3 reciprocations, and after cleaning, copies were made and changed in image irregularities were compared. After the cleaning device 50 accomplished cleaning via 3 reciprocations, 500 copies were made, and changes in noise rankings were examined. These noise rankings are identical to those described in Table 1.

The results of this experiment are shown in Table 2. Table 2 shows results when the speed ratio of the rotational speed of the brush rollers 51*a* and 51*b* and the movement speed of the cleaning member 50 is zero (0), and when brush rollers 51*a* and 51*b* were fixedly mounted and did not rotate.

TABLE 2

| Speed ratio | 1 reciprocation | 3 reciprocations | After 500 copies |
|---|---|---|---|
| 0 | Δ | ○ | Δ |
| 1 | X | ○ | X |
| 1.2 | ○ | ◎ | ◎ |
| 1.5 | ◎ | ◎ | ◎ |
| 2 | ◎ | ◎ | ◎ |
| 3 | ◎ | ◎ | ◎ |

As can be understood from the data in Table 2, when the speed ratio of the rotational speed of the brush rollers 51*a* and 51*b* and the movement speed of the movable member 50 is zero (0), and when the speed ratio of the rotational speed of the brush rollers 51*a* and 51*b* and the movement speed of the movable member 50 is 1, a large amount of residual toner remained on the plate electrode 2 after only one reciprocation of the cleaning device 50, and severe image irregularities were produced. When the cleaning device 50 was reciprocated once at a speed ratio of 1.2, some toner remained, but image irregularity was not a problem from a practical standpoint. When the speed ratio was 1.5 or greater, all toner was removed, and no image irregularity was produced.

When the cleaning device 50 was reciprocated three times at a speed ratio of 0 or 1, image irregularity was so slight as to be no problem from a practical standpoint. However, image irregularities worsened after 500 copies following cleaning via 3 reciprocations of the cleaning device 50 at speed ratios of 0 or 1. This deterioration is believed to occur because the adhered or remaining toner near the tip of the plate electrode 2 is moved via the electrical force generated during discharge so as to be re-adhered to electrode tip when the speed ratio is 0 or 1. On the other hand, when the speed ratio is 1.2 or greater, there is no worsening of the image irregularity after 500 copies following cleaning.

When the speed ratio is excessively increased, i.e., when the rotational speed of the brush rollers 51*a* and 51*b* is too great, follicle breakdown results. When follicle breakdown occurs, the broken brush follicles adhere to the surface of the photosensitive member, thereafter contaminating the developing devices, jamming the sleeve rollers, become inserted between the cleaning blade and the photosensitive member so as to damage the surface of said photosensitive member, and damaging the cleaning blade. The present experiments were conducted within the speed ratio range up to a ratio of 3, and no follicle breakdown occurred. The same results shown in Table 2 were obtained when identical tests were conducted with brush follicle density of about 6,000 follicles/cm$^2$ on the brush rollers 51*a* and 51*b*.

2. Rotational direction of brush rollers 51*a*, 51*b*

The rotational direction of the brush rollers 51*a* and 51*b* may be the same direction Q relative to the movement direction movable member 50 (hereinafter referred to as "direction Q"), as shown in FIG. 17, or the counter direction R. However, there is a possibility that when the brush rollers 51*a* and 51*b* are rotated in the direction Q, the toner and the like removed by the brush rollers 51*a* and 51*b* are scattered to the previously cleaned surface of the plate electrode 2. Thus the counter direction R is the preferred direction of rotation of the brush rollers 51*a* and 51*b*.

3. Amount of offset

Changing cleaning effectiveness of the cleaning device 50 by the amount of the previously mentioned offset, i.e., the difference between the radius of the brush rollers 51*a* and 51*b* and the distance from the center of rotation of said rollers 51*a* and 51*b* to the side surface of the plate electrode 2 is considered hereinafter.

Using the cleaning device 50 provided with brush rollers 51*a* and 51*b* having a brush density of about 1,000 follicles/cm$^2$, the brush follicle offset was variously modified, and the plate electrode 2 was cleaned at rotation ratio of 1.5 with 1 reciprocation. These experiments were conducted by controlling a constant current of −600 μA to apply a voltage to the plate electrode 2 during 100 hours of continuous discharge of said plate electrode 2, just as in previous experiments. After toner was adhered to the entirety of the plate electrode 2 to produce severe image irregularities, the offset of the cleaning member 50 of the aforesaid construction was variously modified and cleaning was performed, then single sample copies were made and their respective noise rankings compared. Although the offset was changed by altering the distance between the rotating shafts 53*a* and 53*b*, the brush follicle length may also be modified.

Table 3 shows the results of the aforesaid tests.

TABLE 3

| Offset | Rank | Drive condition |
|---|---|---|
| Approx. 0 mm | ○ | ○ |
| Approx. 0.5 mm | ◎ | ○ |
| Approx. 1 mm | ◎ | ○ |
| Approx. 1.5 mm | ◎ | ○ |
| Approx. 2 mm | ◎ | ○ |
| Approx. 2.5 mm | — | X |

As can be understood from the data in Table 3, if the brush rollers 51*a* and 51*b* make contact with the plate electrode 2, image irregularities recovered to the point of being no problem from a practical standpoint even when the offset was zero (0). However, when the offset was zero (0), there is a possibility of producing unsatisfactory contact due to errors in assembling the cleaning device 50, and errors in brush diameter during manufacture. When the offset is 2.5 mm, the frictional force increases between the brush follicles and the plate electrode 2 thereby increasing the drive torque of the motor 57, resulting in uneven drive. It can be understood, therefore, that a brush follicle offset of from 0.5 mm to 2.0 mm is desirable.

Although in the second embodiment of the present invention described above nylon was used as the brush follicle material for brush rollers 51*a* and 51*b*, it is to be noted that other insulative materials may alternatively be used. Furthermore, electrically conductive materials may also be used; when the brush follicles are made of a conductive material, the cleaning effectiveness of the cleaning device 50 may be improved by applying a bias voltage to the brush rollers 51*a* and 51*b* so as to discharge the debris adhering to the plate electrode 2.

Flickers may be provided in the vicinity of the brush rollers 51*a* and 51*b* to remove the toner and the like adhering to said brush rollers 51*a* and 51*b*.

Figure 18A:
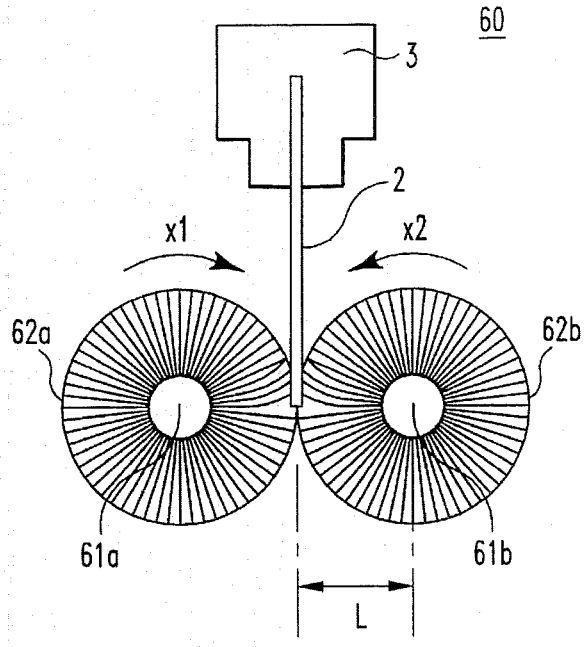
FIGS. 18(*a*) and 18(*b*) are section views of a cleaning device of a third embodiment.

A third embodiment of the corona charging device of the present invention is described hereinafter. FIGS. 18(*a*) and 18(*b*) are section views of the cleaning device 60 provided with a third embodiment of the corona charging device. The cleaning device 60 comprises rotating shafts 61*a* and 61*b* arranged parallel in the lengthwise direction of the plate electrode 2 and which are shorter than said plate electrode 2, rotating members 62*a* and 62*b* which respectively rotate in the arrow X1 and arrow X2 directions and which act as the axes of the rotating shafts 61*a* and 61*b*, and a drive mechanism (not illustrated) which rotates said rotating shafts 61*a* and 61*b* and reciprocally moves the cleaning device 60 along the lengthwise direction of the plate electrode 2.

Figure 18B:
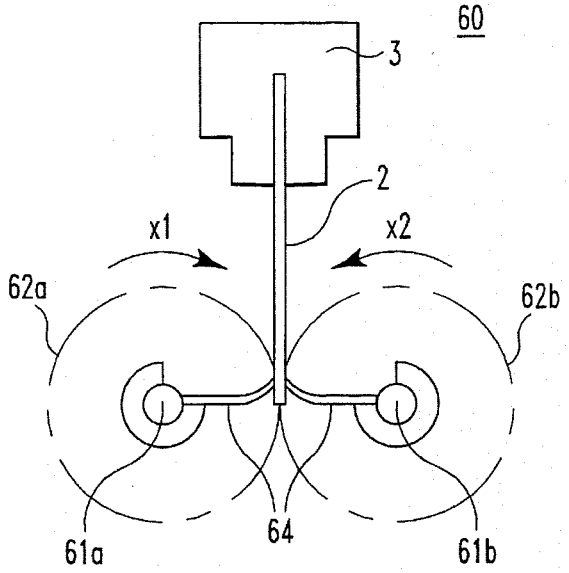
Figure 19:
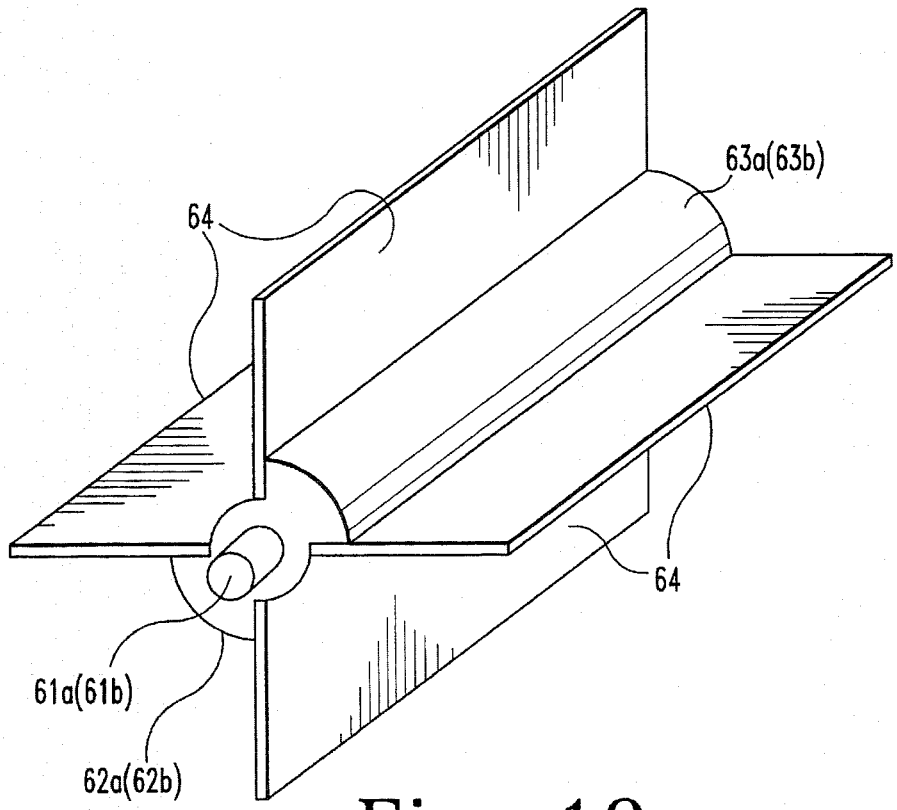
FIG. 19 is an illustrations showing the construction of a rotating member of FIG. 18.

The rotating members 62*a* and 62*b* are provided with four blade members 64 comprising flexible sheets equally spaced on the rotating bodies 63*a* and 63*b* acting as the rotating shafts 61*a* and 61*b*, as shown in FIG. 19. The rotational radius R of the rotating members 62*a* and 62*b* shown in FIG. 18*b* is greater the distance L from the center of the rotating shafts 61*a* and 61*b* to the plate electrode 2, such that the rotating members 62*a* and 62*b*, i.e., blade members 64, reliably make contact with the surface of the plate electrode 2. The four blade members 64 remove adhered debris while in contact with the side surfaces of protrusions 2*a* of the plate electrode 2 via the rotation of the rotating members 62*a* and 62*b*. If the blade members 64 are constructed of electrically conductive material, cleaning effectiveness can be improved by grounding or applying a bias voltage to discharge the adhered debris.

The drive mechanism is provided with a sensor for detecting whether or not the cleaning device 60 is at the initial position relative to the direction of advance when cleaning starts (start position sensor), and a sensor for detecting the state of the blade members 64 (blade sensor). These two sensors allow positional adjustment of the edge portion of the blade members 64 between the individual protrusions 2*a* so as to avoid overlapping said protrusions 2*a*. The time required to move the cleaning device 60 a distance of 1 pitch of the protrusions 2*a*, and the time required after one blade member 64 is in contact with the plate electrode 2 until the next blade 64 is in contact with the plate electrode 2 are adjusted so as to be equal. This adjustment may be accomplished by controlling the travel speed of the cleaning device 60 and the rotation of the rotating members 62*a* and 62*b* by the following method.

$$v1/p=v2/(2\pi r/X)$$

Where the elements of the equation are defined as follows:

v1: travel speed of cleaning device 60 p: pitch of plate electrode 2 (protrusion 2*a*, FIG. 2)

v2: rotational speed (circumferential speed) of rotating members 62*a* and 62*b* r: rotational radius of rotating members 62*a*, 62*b*

X: number of blade members 64

$2\pi r/X$: amount of movement in circumferential direction of blade members 64

Control via the aforesaid equation prevents contact of the edge of the blade members 64 with the protrusions 2*a* when the cleaning member 60 travels in the lengthwise direction while cleaning the plate electrode 2, and prevents the blade members 64 from bending the protrusions 2*a*.

Since the length of the rotating members 62*a* and 62*b* are the length of a plurality of pitch segments of the protrusion 2*a*, the blade members 64 make a number of contact with the same protrusion 2*a* during a single cleaning, thereby increasing cleaning efficiency.

The rotating members 62*a* and 62*b* of the third embodiment may alternatively be brushes provided with follicles.

Figure 20:
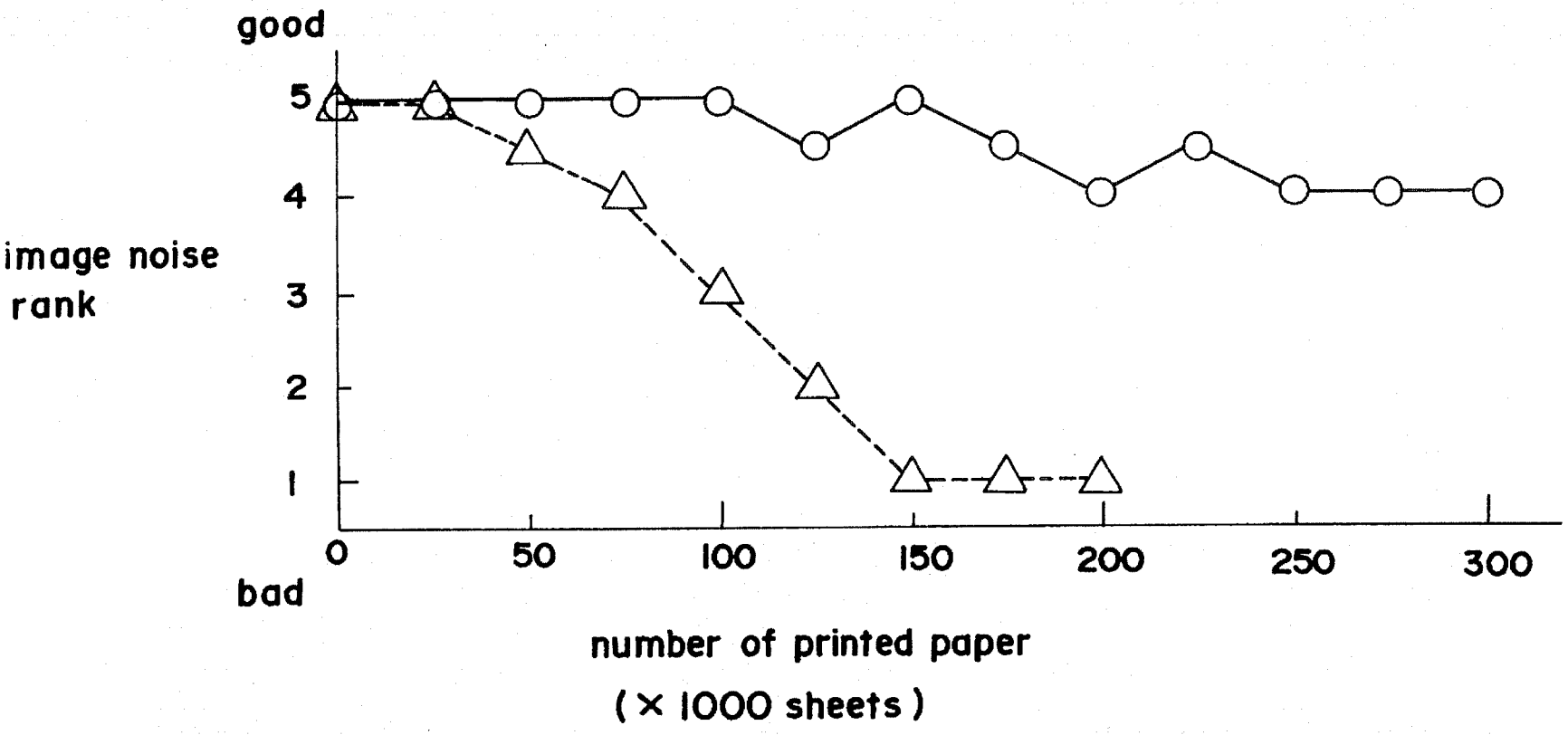
FIG. 20 is a graph showing the change in noise ranking during printing tests using copiers both with and without the corona charger of the present invention.
Figure 21:
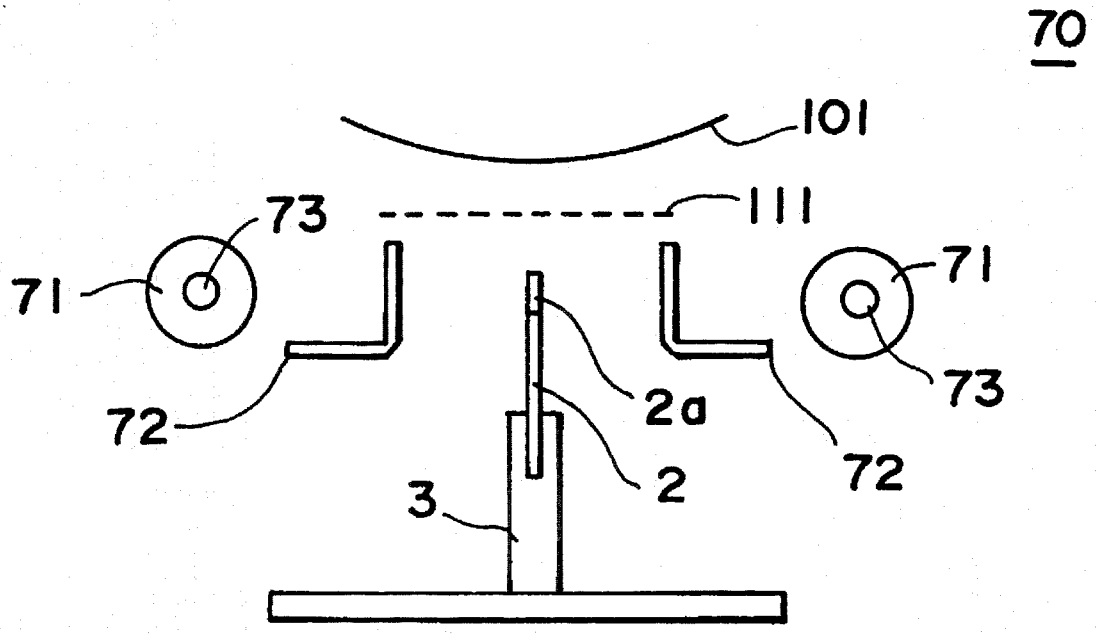
FIG. 21 is a partial view showing a discharge relative to a photosensitive member in a charging device of the fourth embodiment.

The cleaning effectiveness of the aforesaid cleaning device 60 is described hereinafter with reference to FIG. 20. FIG. 20 is a graph showing the change in image noise ranking caused by charging irregularities in printing tests by copiers using a corona charging device provided with a plate electrode 2 as the charger. The horizontal axis in the graph expresses the number of printed sheets, and the vertical axis expresses the noise rank evaluated in 5 levels of image noise. In this printing test, a constant current source was used as the power source supplying power to the plate electrode 2, said current being controlled at −600 μA. The solid line in the graph indicates printing test data using a corona charging device provided with the cleaning device 60. In this test, the plate electrode 2 was cleaned by the cleaning device 60 after each 10,000 copies. The dashed line in the graph indicates printing test data using a corona charging device which was not provided with the cleaning device 60. A comparison of the two graphs shows that the noise rank was 3 after 100,000 copies when the cleaning device 60 was not used. However, a noise rank of 4 was maintained even after 300,000 copies when the cleaning device 60 was provided in contrast to the image noise which worsened to rank 2 after just 125,000 copies when cleaning device 60 was not used.

The frequency of the cleaning of the plate electrode 2 by the cleaning device 60 may be set for a constant number of copies or a constant time interval. Furthermore, the plate electrode 2 may be cleaned by the cleaning device 60 via manual operation.

The receiving section for accommodating the cleaning devices 50 and 60 described in the first embodiment may also be provided in the second and third embodiments.

Figure 22:
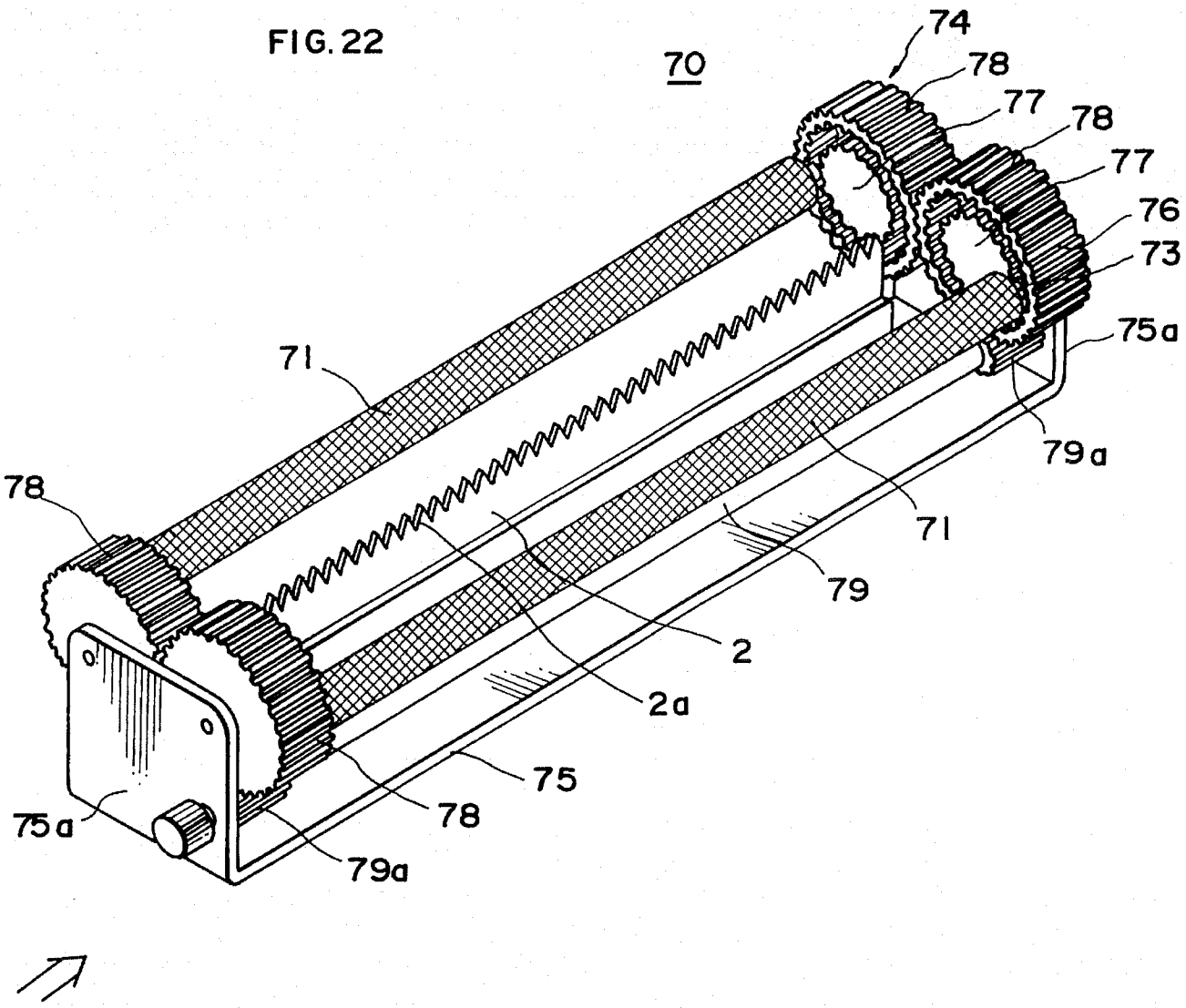
FIG. 22 is a perspective view showing a cleaning device provided with the charging device of the fourth embodiment.
Figure 23:
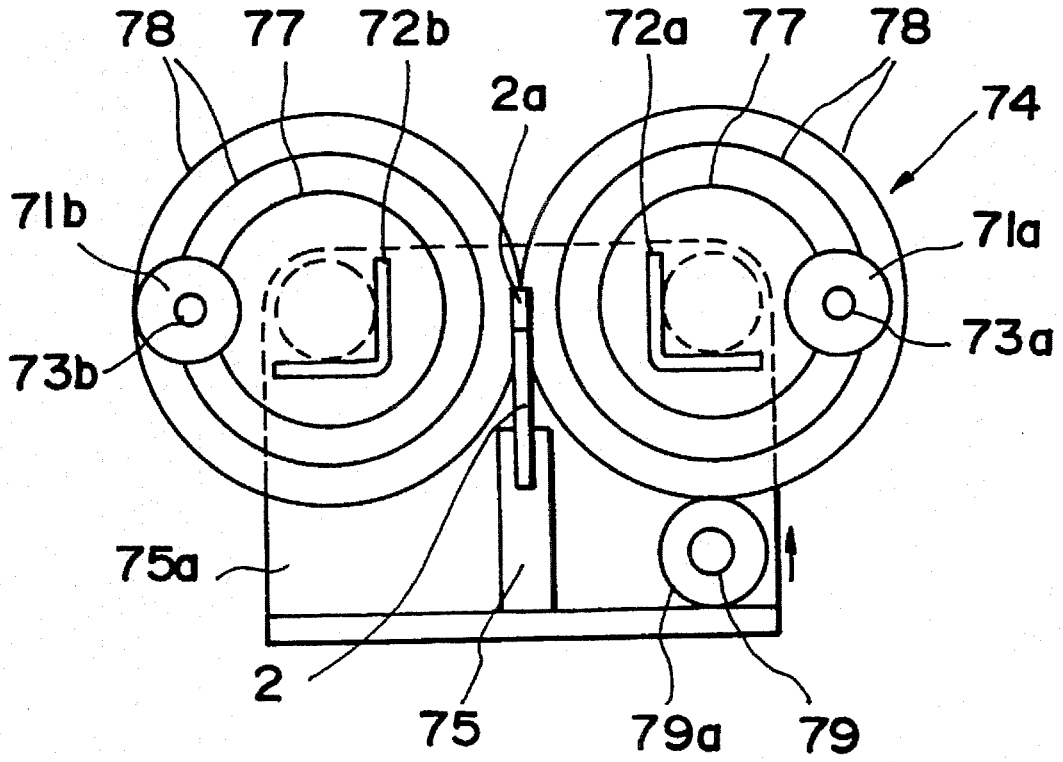
FIG. 23 is a section view showing the cleaning device of FIG. 22 viewed from the arrow direction.

A fourth embodiment of the charging device of the present invention is described hereinafter with reference to FIGS. 22 and 23.

In the fourth embodiment, the plate electrode 2 is arranged in the axial direction of the photosensitive member 101, and a screen grid 111 is interposed medially to the photosensitive member 101 and the serrated protrusions 2*a* formed on the plate electrode 2. When a voltage is applied to the aforesaid plate electrode 2, a discharge is produced from the leading end of the serrations opposite the photosensitive member 101 toward said photosensitive member 101.

The charging device of the fourth embodiment is provided with a cleaning device 70 having stabilizers 72 suitably spaced bilaterally on the plate electrode 2, and cleaning rollers 71 disposed along the lengthwise direction of the plate electrode 2 as cleaning members that clean by gripping the plate electrode 2.

In the aforesaid cleaning device 70, the pair of cleaning rollers 71 grip the plate electrode 2 via a control means 74 only when said pair of cleaning rollers 71 provided bilaterally to the plate electrode 2 are moved toward the tip of the serrated teeth of the protrusions 2*a* of the plate electrode 2.

In the cleaning device 70, small gears 76 are provided at both ends of the shafts 73 of the aforesaid cleaning rollers 71, and the teeth of said small gears 76 engage the inner gears 77 fixedly mounted to a surface of the side panel 75*a* provided in the lengthwise direction of holder 3 bilaterally to the plate electrode 2.

The cleaning rollers 71 are arranged so as to be disposed between the inner gears 77 fixedly attached to side panels 75*a*. The gears 76 provided at both ends of the shafts 73 of the cleaning rollers 71 engage the teeth provided on the exterior surface of the inner gears 77.

On the exterior side of the inner gears 77 may be provided outer gears 78 having teeth on both the interior side and exterior side thereof and disposed so as to be rotatable on the surface opposite the side panels 75*a*. The teeth on the interior side of the outer gears 78 engage the gears 76 of the cleaning rollers 71, and the teeth on the exterior side of the pair of outer gears 78 provided on the side panels 75*a* mutually engage one another.

In the charging device of the present embodiment, the plate electrode 2 is cleaned by a pair of cleaning rollers 71. The drive shaft 79 is rotated, and the outer gear 78, which engages the teeth on the exterior side of the drive gear 79*a* provided on said drive shaft 79, is rotated from the edge of the plate electrode 2 supported by the holder 3 to the protrusions 2*a*.

When the outer gear 78 engaged with the drive gear 79*a* of the drive shaft 78 is rotated, the other outer gear 78 mutually engaging the exterior teeth provided on the same side panel 75 is rotated in the opposite direction to the aforesaid outer gear 78 via the aforesaid rotation of the first outer gear 78, such that the outer gear 78 is rotated from the edge of the plate electrode 2 supported by the holder 3 toward the protrusion 2*a*.

When the outer gear 78 is rotated as described above, the gear 76 engaging the interior teeth of said outer gear 78 is also rotated via said rotation of the outer gear 78, so as to move along the circumference of the interior gear 77 in the same direction as the rotational direction of said outer gear 78 engaging the inner gear 77. As a result, the cleaning rollers 71 mounted on the gears 76 rotate and revolve in the same direction as the rotational direction of the outer gear 78 along the exterior of the inner gears 77.

Figure 24A:
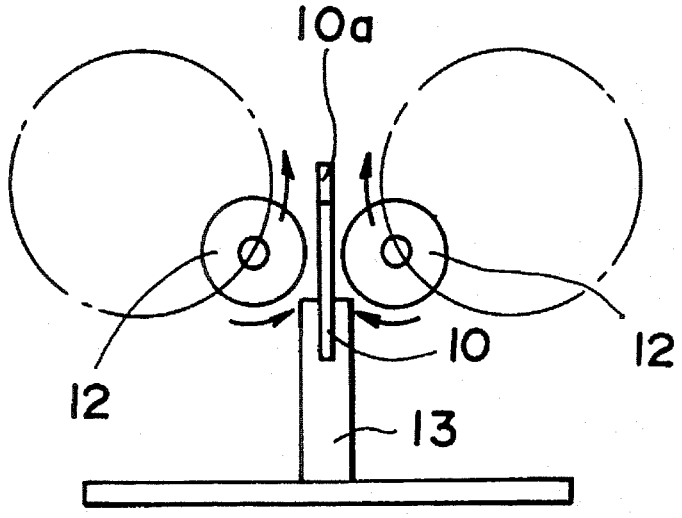
FIGS. 24(*a*), 24(*b*) and 24(*c*) are brief process illustrations showing the process of cleaning the plate electrode via the cleaning device of FIG. 22.
Figure 24B:
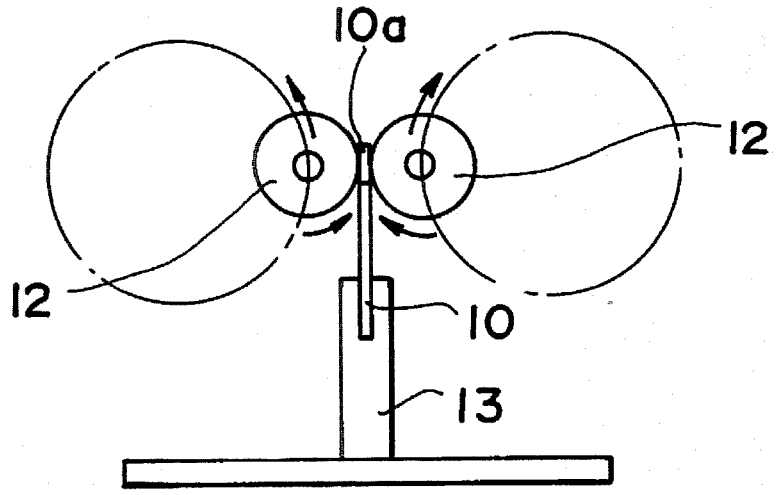
Figure 24C:
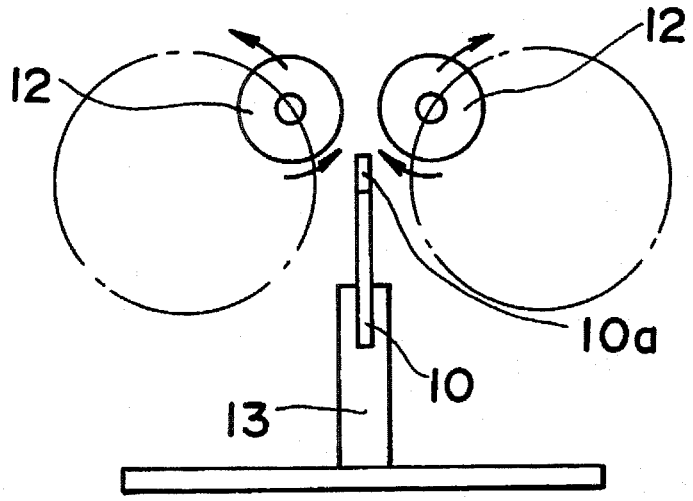

When the cleaning rollers 71 rotate and revolve in the same direction as the rotational direction of the outer gear 78 along the exterior of the inner gears 77, the cleaning rollers 71 gradually approach the plate electrode 2, as shown in FIG. 24(*a*), and said cleaning rollers 71 grip both sides of the plate electrode 2, as shown in FIG. 24(*b*). In this state, the cleaning rollers 71 rotate and revolve along the exterior of the inner gear 77, thereby moving to the edge of the serration of the protrusions 2*a* of plate electrode 2, such that said protrusions 2*a* of the plate electrode 2 are cleaned by the cleaning rollers 71.

After the protrusions 2*a* of the plate electrode 2 are cleaned by the cleaning rollers 71, said cleaning rollers 71 rotate and revolve along the exterior of the inner gear 77, thereby gradually separating from the plate electrode 2, and returning to their original positions as shown in FIG. 24(*c*).

When the protrusions 2*a* are cleaned as plate electrode 2 is gripped by the cleaning rollers 71 only when said cleaning rollers 71 move to the edge of the serration of the protrusions 2*a* of the plate electrode 2, the cleaning rollers 71 do not bend the serration of the protrusions 2*a*, thereby avoiding warping or damaging said protrusions 2*a*, and reliably cleaning the protrusions 2*a* of the plate electrode 2.

Figure 25:
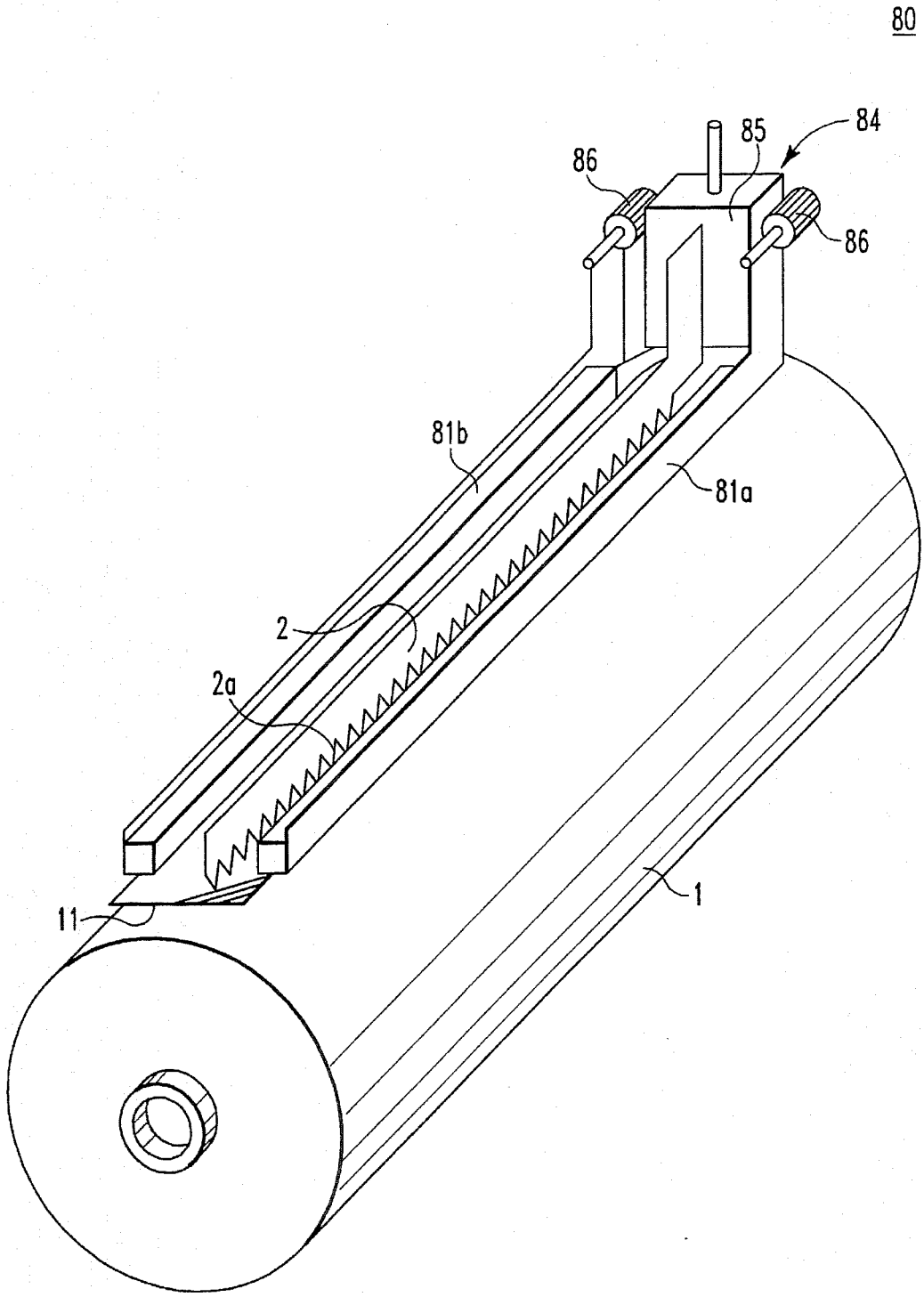
FIG. 25 is a partial illustration showing a discharge relative to the photosensitive member in a charging device of a fifth embodiment.

A fifth embodiment of the charging device of the present invention is described hereinafter. As shown in FIG. 25, the fifth embodiment is provided with a plate electrode 2 arranged in the axial direction of the photosensitive member 101, and a screen grid 111 disposed medially to the photosensitive member 101 and protrusions 2*a* of the plate electrode 2. A pair of cleaning members 81 which grip and clean the plate electrode 2 are provided bilaterally to said plate electrode 2.

In the charging device of the fifth embodiment, a pair of cleaning members 81 grip the plate electrode 2 via a control means 84 only when said pair of cleaning rollers 81 confront the edge of the serration of protrusions 2*a* of said plate electrode 2. The edge of the plate electrode 2 in the lengthwise direction is supported by a holder 85 which is movable in one direction and an opposite direction, and a rack 85*a* is provided on the side walls bilaterally to a holder 85 such that the plate electrode 2 is movable in one direction and an opposite direction between the pair of cleaning members 81. The cleaning members 81 are mounted via a clutch mechanism (not illustrated) to the gears 86 which engage said rack 85*a* and rotate.

In the aforesaid clutch mechanism, the cleaning members 81 are rotated to the side of the plate electrode 2 together with the gear 86 which rotates while engaged with the rack 85*a*, such that said cleaning rollers 81 grip the plate electrode 2 only when the holder 85 is moved in one direction relative to the cleaning members 81. On the other hand, only the gear 86 rotates while engaging the rack 85*a* when the holder 85 is moved in an opposite direction relative to the cleaning members 81, such that the cleaning members 81 do not operate.

In the stage prior to cleaning of the plate electrode 2 by the cleaning members 81 as shown in FIG. 25, the holder 85 is moved downward, so as to position the protrusions 2*a* of the plate electrode 2 below the cleaning members 81, and the gears 86 mounted on each cleaning member 81 is maintained in a state of engagement on the top of the rack 85*a* provided on the side walls of the holder 85.

Figures 26A, 26B, 26C, 26D:
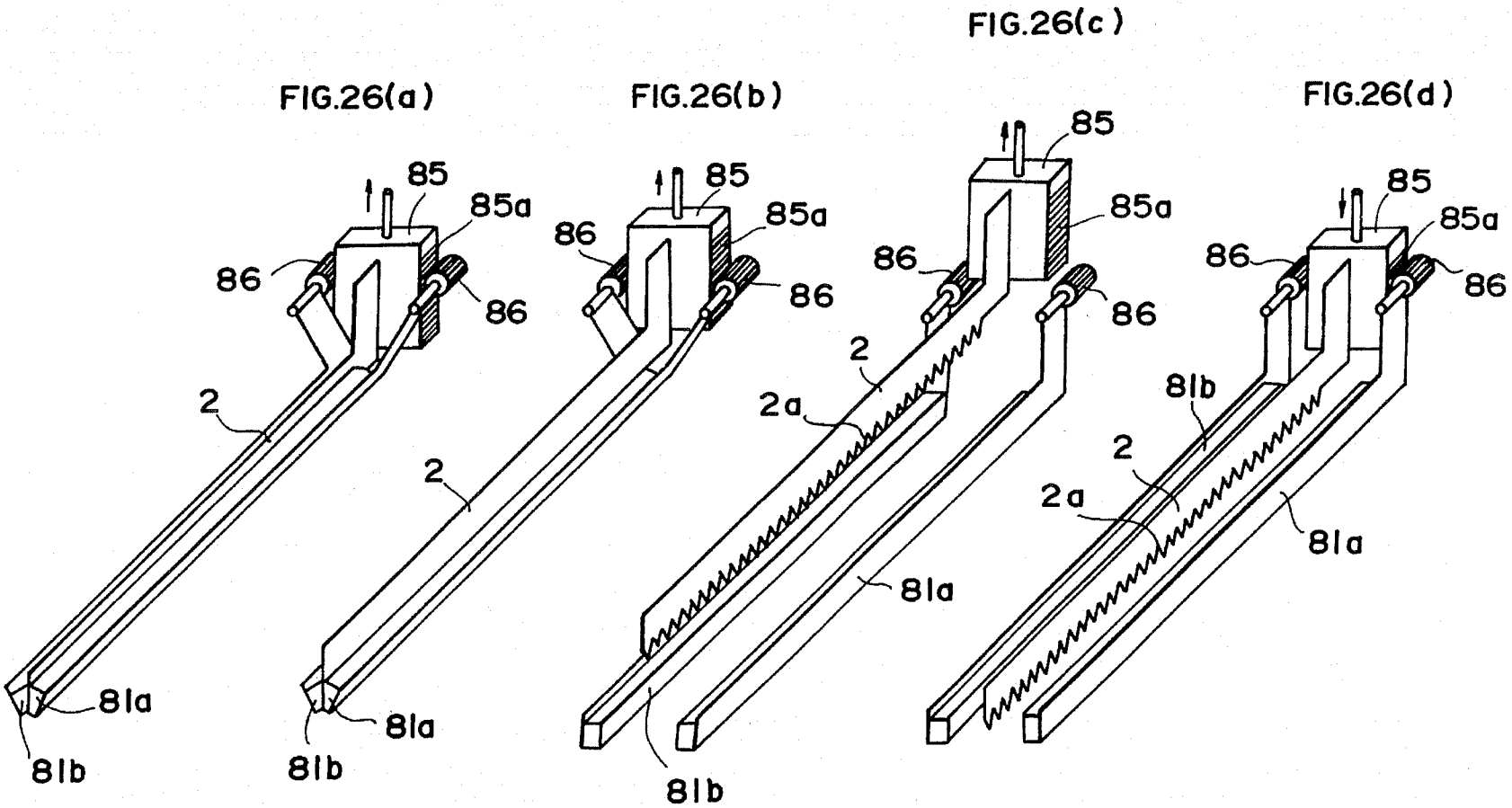
FIGS. 26(*a*), 26(*b*), 26(*c*) and 26(*d*) are brief process illustrations showing the process of cleaning the plate electrode via a cleaning device provided with the charging device of the fifth embodiment.

When the plate electrode 2 is cleaned by the pair of cleaning members 81, the previously mentioned holder 85 is moved upward, so as to lift the plate electrode 2 upward, as shown in FIG. 26(*a*).

When the holder 85 is moved upward, the previously mentioned gear 86 engages the rack 85*a* and is rotated, the cleaning members 81 rotate on the sides of the plate electrode 2 in conjunction with the rotation of said gear 86, and the plate electrode 2 is gripped between said cleaning members 81.

With the plate electrode 2 gripped between the cleaning members 81 as previously described, the holder 85 is moved upward thereby lifting the plate electrode 2 upward as shown in FIG. 26(*b*). The protrusions 2*a* of the plate electrode 2 are introduced between the cleaning members 81 and cleaned.

The holder 85 is lifted even after the protrusions 2*a* of the plate electrode 2 are cleaned by the cleaning members 81, such that the plate electrode 2 is extracted from between said cleaning members 81, and the holder 85 is extracted from between the gears 86, as shown in FIG. 26(*c*). Thus, when the holder 85 is extracted from between the gears 86, the cleaning members 81 are pressed together and mutually rotate of their own weight, thereby separating to form an open state.

With the cleaning members 81 in the aforesaid mutually open state, the holder 85 is moved downward so as to be interposed between the gears 86, as shown in FIG. 26(*d*). The holder 85 is moved downward, and the cleaned protrusions 2*a* of the plate electrode 2 are positioned below the cleaning members 81, as shown in FIG. 25.

When the holder 85 is moved downward and medially to the gears 86, only the gears 86 engage the rack 85*a* and are rotated via the previously mentioned clutch mechanism, such that the cleaning members 81 remain open and without rotating the cleaning members 81.

When the cleaning members 81 clean the plate electrode 2, reliable cleaning occurs without said cleaning members 81 bending the serrations of the protrusions 2*a* of the plate electrode 2, or warping or damaging said protrusions 2*a*, just as in the fourth embodiment.

A sixth embodiment of the charging device of the present invention is described hereinafter.

In the sixth embodiment of the charging device, a plate electrode 2 is provided in the axial direction of the photosensitive member 101, and a screen grid 111 is arranged medially to the photosensitive member 101 and the protrusions 2*a* of the plate electrode 2, just as in the fourth and fifth embodiments, although not shown in the drawings.

Figure 27:
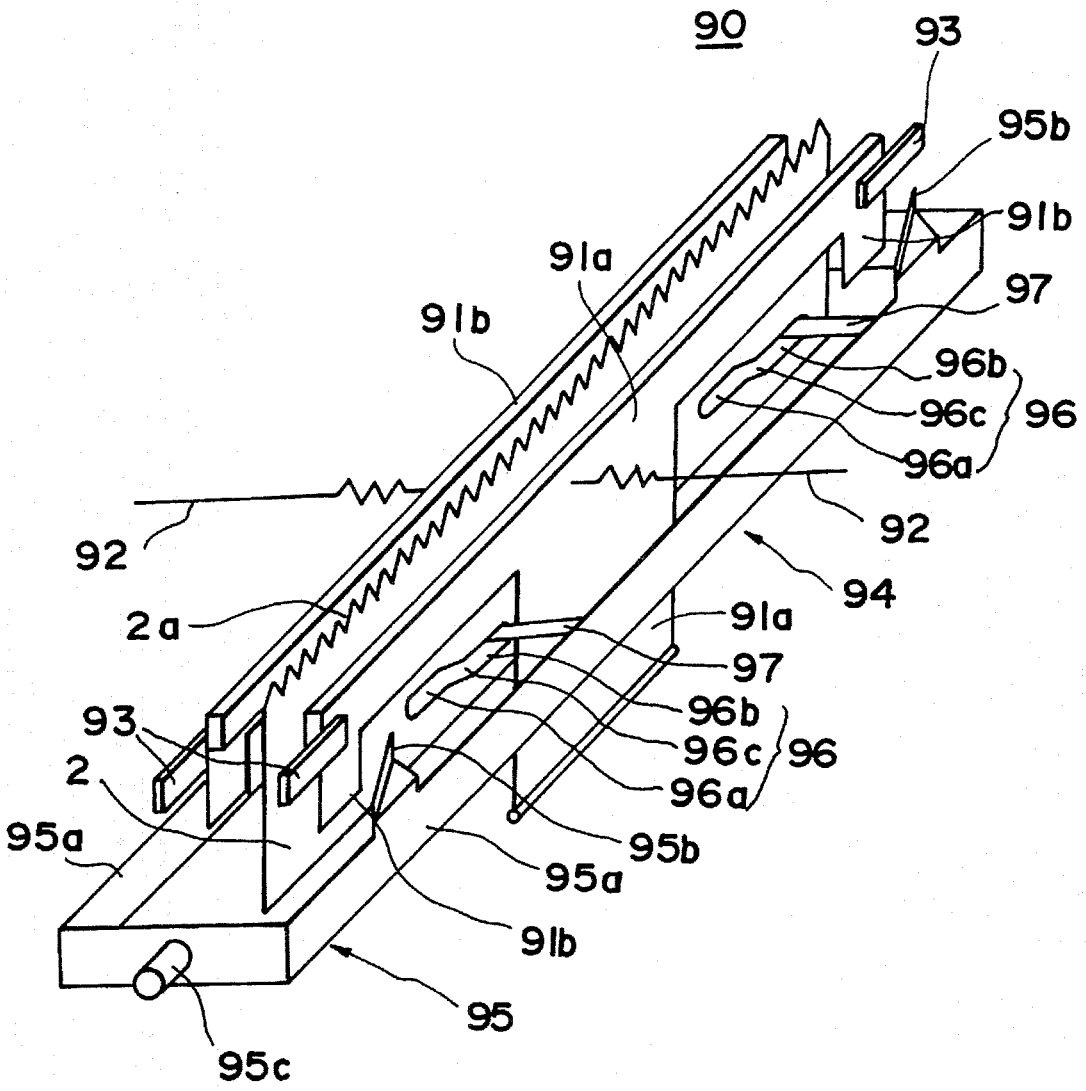
FIG. 27 is an illustration of a cleaning device provided with a charging device of a sixth embodiment.

In the charging device of the sixth embodiment, a pair of cleaning members 91 are provided bilaterally to the plate electrode 2 to grip and clean said plate electrode 2. As shown in FIG. 27, each cleaning members 91 is supported by a holder 91*a* extending from the center of each cleaning member 91 in the lengthwise direction.

In the center of each cleaning member 91 in the lengthwise direction is mounted a spring 92 on the side opposite the plate electrode 2. These springs 92 pull the cleaning members 91 on the side opposite the plate electrode 2. A stop member 93 is provided on both ends of the cleaning members 91 on the side opposite the plate electrode 2. These stop members 93 control the pulling of the cleaning members 91 on the side opposite the plate electrode 2 as required.

The charging device of the sixth embodiment provides a pair of cleaning members 91 which grip the plate electrode 2 via a control means 94 only when said pair of cleaning members 91 confront the serrations of protrusions 2*a* of the plate electrode 2. As shown in FIG. 27, a frame 95 is provided so as to be movable in the lengthwise direction and circumscribe the plate electrode 2 and cleaning members 91. A pair of members 95*b*, which extend at an inclination from the bilateral frames 95*a* extending in the lengthwise direction of the frame 95, protrude toward the cleaning members 91. When the frame 95 is moved along the lengthwise direction of the plate electrode 2 and cleaning members 91 to the front side, the leg member 91*b* extending bilaterally to the cleaning members 91 in the lengthwise direction press gradually to the side of the plate electrode 2.

In the charging device of the present embodiment shown in FIG. 27, an inclined guide channel 96 is provided from the front top level 96*a* to the interior bottom level 96*b* on both sides of the plate electrode 2 in the lengthwise direction. Pins 97 which extend from the side frame 95*a* are inserted in the aforesaid guide channels 96, and are positioned at the bottom level 96*b* in the guide channel 96 before the frame 95 moves to thee front along the lengthwise direction of the plate electrode 2 and cleaning members 91.

Figure 28:
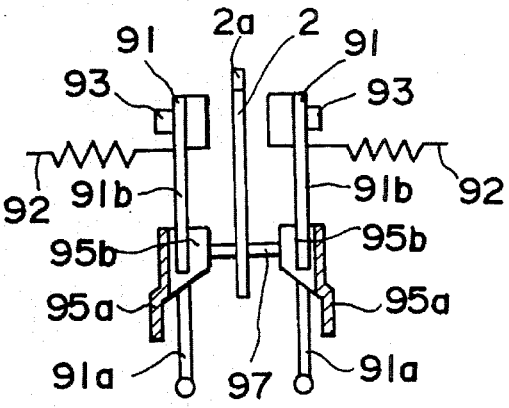
FIGS. 28(*a*), 28(*b*), 28(*c*) and 28(*d*) are brief process illustrations showing the process of cleaning the plate-like electrode via the cleaning device of FIG. 27.
Figure 28B:
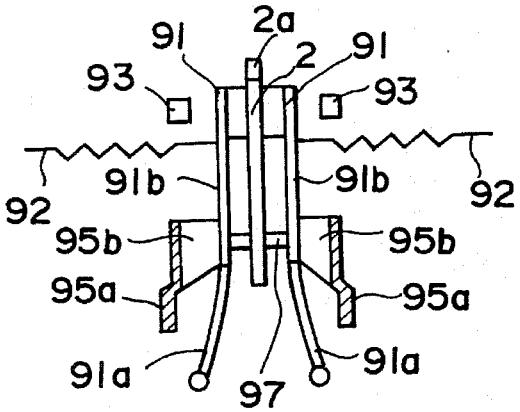
Figure 28C:
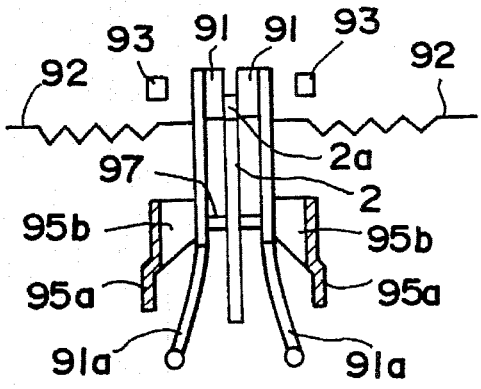
Figure 28D:
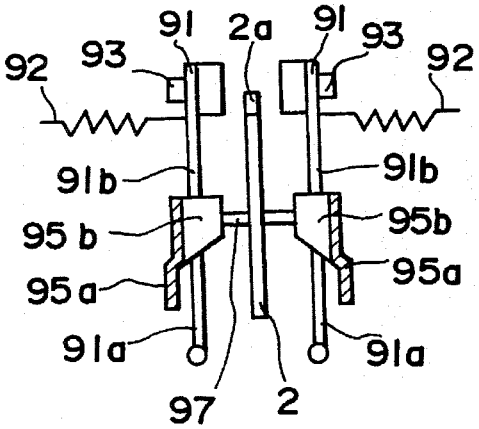
Figure 28E:
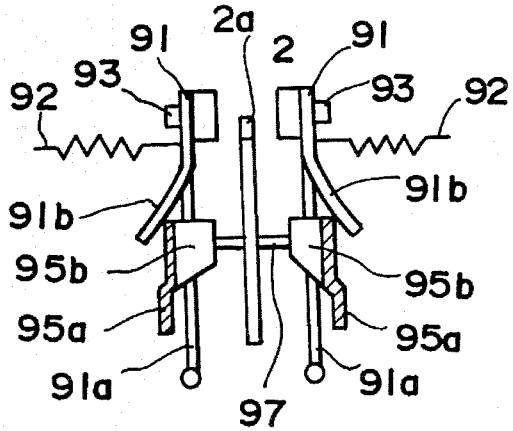

As shown in FIG. 27 and FIG. 28(*a*), when the plate electrode 2 is cleaned by the cleaning members 91, the pins 92 provided on the frame 95 are positioned at the bottom level 96*b* inside the guide channel 96, and the pair of cleaning members 91 are separated on both sides of the plate electrode 2, such that said frame 95 is moved to the front along the lengthwise direction via a lever 95*c* provided on the front side of said frame 95.

When the frame 95 is moved to the front side, the leg members 91*b* of the cleaning members 91 are pressed to the side of the plate electrode 2 via the member 95*b* of the frame 95. Each cleaning member 91 is gradually pulled to the plate electrode 2 via the tension of the spring 92, such that the plate electrode 2 is gripped between the cleaning members 91, as shown in FIG. 28(*b*).

When the frame 95 is moved to the front side with the plate electrode 2 gripped between the cleaning members 91, the pins 97 travel from the bottom level 96*b* of the guide channels 96 provided on the plate electrode 2 and are guided through the inclined section 96*c* to the top level 96*a*. Thus, the plate electrode 2 is moved downward, and the protrusions 2*a* are interposed medially to the cleaning members 91, as shown in FIG. 28(*c*) to achieve cleaning.

The frame 95 is moved to the front side even after the protrusions 2*a* are cleaned by the cleaning members 91, such that the members 96*b* pass the leg members 91*b* of the cleaning members 91. When the members 96*b* pass the leg members 91*b* of the cleaning members 91, the cleaning members 91 gripping the plate electrode 2 form an opening therebetween via the tension of the aforesaid spring 92, such that the plate electrode 2 is released.

After the plate electrode 2 is released, the frame 95 which was moved to the front side is pushed to the inside and returns to its original position.

Thus, when the aforesaid frame 95 is pushed to the inside, the leg members 91*b* of the cleaning members 91 are moved to the outside of the members 95*b* of the frame 95. As shown in FIG. 28(*e*), the leg members 91*b* press the members 96*b* and are gradually bent, so as to pass the members 96*b* and return to their original position shown in FIG. 28(*a*), and the pins 97 provided on the frame 95, in the reverse of the previous description, are conducted from the top level 96*a* of the guide channels 96 of the plate electrode 2, pass through the inclined section 96*c* to the bottom level 96*b*. Thus, the plate electrode 2 is moved upward to its original position, as shown in FIG. 27.

In this embodiment, when the cleaning members 91 clean the plate electrode 2, the cleaning members 91 reliably clean without bending the serrations of protrusions 2*a* of the plate electrode 2, or warping or damaging the edge portions thereof.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A charging device comprising:

a plate-like electrode provided with a plurality of protrusions;

a cleaning device including rotatable cleaning members provided bilaterally to said electrode and gripping said electrode therebetween to clean said electrode; and a guide member provided along said electrode so as to slidably guide said cleaning device thereon.

2. The charging device as claimed in claim 1, wherein said cleaning members are a pair of rotatably supported rollers, each roller has a rotation axis perpendicular to a lengthwise direction along the electrode.

3. The charging device as claimed in claim 2, wherein said pair of rollers is a pair of brush rollers slidable along said electrode.

4. The charging device as claimed in claim 2 further comprising a driving device for rotating said pair of rollers.

5. The charging device as claimed in claim 4, wherein said driving device slides said pair of rollers along said electrode.

6. The charging device as claimed in claim 3, wherein the moving speed of the peripheral surfaces of said rollers is faster than the speed at which said pair of rollers slides along said electrode.

7. The charging device as claimed in claim 1 further comprising a receiving member in the vicinity of said cleaning member which receives particles removed from said electrode by said cleaning members.

8. The charging device as claimed in claim 1, wherein said cleaning device includes second cleaning members for cleaning the surface of first cleaning members.

9. The charging device as claimed in claim 8, wherein each said second cleaning member is a brush contacting with each said first cleaning member.

10. The charging device as claimed in claim 8, wherein each said second cleaning member is a flexible sheet, one end of the flexible sheet being attached to the cleaning device and the other free end thereof contacting with each said first cleaning member.

11. The charging device as claimed in claim 1, wherein said cleaning members include first members which clean the protrusions of said electrode and second members which clean a base portion thereof.

12. The charging device as claimed in claim 1 further comprising a shield section provided outside a discharge region of said electrode so as to accommodate and shield said cleaning device from the discharge region during discharge by said electrode.

13. The charging device as claimed in claim 1 further comprising a cover member provided on said cleaning member for covering said cleaning member.

14. The charging device as claimed in claim 1, wherein said cleaning members are a pair of rollers having a rotational axis along said electrode.

15. A charging device comprising:

a plate-like electrode provided with a plurality of protrusions on its one end portion which confronts an image bearing member; and cleaning members provided bilaterally to and along said electrode and gripping said electrode therebetween to accomplish cleaning, the cleaning members extending to full length of the electrode.

16. The charging device as claimed in claim 15, wherein said cleaning members are a pair of rollers having its rotational axis along said electrode.

17. The charging device as claimed in claim 15 further comprising a system which causes said cleaning members to grip said electrode only when said cleaning members are moved from a base toward an edge of the protrusions of said electrode.

18. A charging device comprising:

a plate-like electrode provided with a plurality of protrusions on its one end portion which confronts an image bearing member;

cleaning members provided bilaterally to and along said electrode and gripping said electrode therebetween to accomplish cleaning; and a system which causes said cleaning members to grip said electrode only when said cleaning members are moved from a base toward an edge of the protrusions of said electrode.

19. The charging device as claimed in claim 18, wherein said cleaning members are a pair of rollers having a rotational axis along said electrode.

* * * * *

UNITED STATES PATENT AND TRADEMARK OFFICE

CERTIFICATE OF CORRECTION

PATENT NO. : 5,532,798

DATED : July 2, 1996

INVENTOR(S) : Yasuhiro Nakagami, et al.

It is certified that error appears in the above-indentified patent and that said Letters Patent is hereby corrected as shown below:

On the cover page, line 8 of the Abstract , change "griping" to --gripping--.

In Col. 3, line 46, change "illustrations" to --illustration--.

In Col. 4, line 32, after "2(b)", insert --, 3(a)--.

In Col. 5, line 64, change "ar" to --at--.

In Col. 7, line 27, after "cleaning", insert --device--.

In Col. 8, line 25, change "mare" to --are--.

In Col. 10, line 48, change "pari" to --pair--.

In Col. 10, line 57, change "charger" (second occurrence) to --chargers--.

In Col. 12, line 43, change "changed" to --changes--.

In Col. 15, line 47, change "contact" to --contacts--.

In Col. 19, line 29, change "thee" to --the--.

UNITED STATES PATENT AND TRADEMARK OFFICE

CERTIFICATE OF CORRECTION

PATENT NO. : 5,532,798

DATED : July 2, 1996

INVENTOR(S) : Yasuhiro Nakagami, et al.

It is certified that error appears in the above-indentified patent and that said Letters Patent is hereby corrected as shown below:

In Col. 22, after the last line, insert the following claim 20.

--20. The charging device as claimed in claim 14, wherein said pair of rollers is slidable along said electrode.--

Signed and Sealed this

Eighth Day of October, 1996

Bruce Lehman

*Attest:*

BRUCE LEHMAN

*Attesting Officer*

*Commissioner of Patents and Trademarks*